US008869549B2

(12) United States Patent
Morimoto et al.

(10) Patent No.: US 8,869,549 B2
(45) Date of Patent: Oct. 28, 2014

(54) HEAT MEDIUM RELAY UNIT AND AIR-CONDITIONING APPARATUS

(75) Inventors: Hiroyuki Morimoto, Chiyoda-ku (JP); Koji Yamashita, Chiyoda-ku (JP); Yuji Motomura, Chiyoda-ku (JP); Katsuhiko Hayashida, Chiyoda-ku (JP); Hiroto Nakao, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 283 days.

(21) Appl. No.: 13/394,707

(22) PCT Filed: Oct. 19, 2009

(86) PCT No.: PCT/JP2009/067978

§ 371 (c)(1), (2), (4) Date: Mar. 7, 2012

(87) PCT Pub. No.: WO2011/048646

PCT Pub. Date: Apr. 28, 2011

(65) Prior Publication Data

US 2012/0180515 A1 Jul. 19, 2012

(51) Int. Cl.

| | |
|---|---|
| ***F25B 13/00*** | (2006.01) |
| ***F25B 41/04*** | (2006.01) |
| ***F24F 3/06*** | (2006.01) |
| ***F25B 25/00*** | (2006.01) |

(52) U.S. Cl.

CPC . *F24F 3/06* (2013.01); *F25B 41/04* (2013.01); *F25B 2313/006* (2013.01); *F25B 13/00* (2013.01); *F25B 25/005* (2013.01)

USPC ..... 62/324.6; 62/525

(58) Field of Classification Search

CPC ..... F25B 25/005; F25B 13/00; F25B 41/04; F25B 2313/006

USPC ..... 62/525, 335, 324.6, 504, 238.7, 513

See application file for complete search history.

(56) References Cited

U.S. PATENT DOCUMENTS

| | | | | | |
|---|---|---|---|---|---|
| 4,596,123 | A * | 6/1986 | Cooperman | ..... | 62/199 |
| 5,058,394 | A * | 10/1991 | Wilkinson | ..... | 62/271 |
| 5,070,703 | A * | 12/1991 | Wilkinson | ..... | 62/94 |
| 7,240,503 | B2 * | 7/2007 | Kang et al. | ..... | 62/238.7 |
| 7,784,297 | B2 * | 8/2010 | Otake et al. | ..... | 62/324.1 |

(Continued)

FOREIGN PATENT DOCUMENTS

| | | | |
|---|---|---|---|
| JP | 5-280818 | A | 10/1993 |
| JP | 6-011203 | A | 1/1994 |
| JP | H07-158912 | A | 6/1995 |
| JP | 2001-289465 | A | 10/2001 |

(Continued)

OTHER PUBLICATIONS

Chinese Office Action dated Nov. 25, 2013 issued in corresponding Chinese Application No. 200980162016.X and an English Translation of the Office Action. (15 pgs.).

(Continued)

*Primary Examiner* — Mohammad M Ali

(74) *Attorney, Agent, or Firm* — Buchanan Ingersoll & Rooney

(57) ABSTRACT

A heat medium relay unit and an air-conditioning apparatus or the like are provided that are compact and have improved serviceability while achieving energy saving. A heat medium relay unit according to the invention includes heat medium delivering devices and heat medium flow switching devices (first heat medium flow switching devices and second heat medium flow switching devices) that are provided so as to be detachable from a predetermined side.

6 Claims, 16 Drawing Sheets

(56) References Cited

U.S. PATENT DOCUMENTS

| | | | | |
|---|---|---|---|---|
| 2006/0037343 | A1* | 2/2006 | Kang et al. | 62/323.1 |
| 2007/0234752 | A1* | 10/2007 | Otake et al. | 62/324.6 |

FOREIGN PATENT DOCUMENTS

| | | | |
|---|---|---|---|
| JP | 2002-106995 | A | 4/2002 |
| JP | 2003-343936 | A | 12/2003 |
| JP | 2004-226015 | A | 8/2004 |
| JP | 2005-140444 | A | 6/2005 |
| JP | 2009-109122 | A | 5/2009 |

OTHER PUBLICATIONS

International Search Report (PCT/ISA/210) issued on Dec. 28, 2009, by Japanese Patent Office as the International Searching Authority for International Application No. PCT/JP2009/067978.

Office Action (Notice of Reasons for Rejection) dated Jun. 25, 2013, issued in corresponding Japanese Patent Application No. 2011-537031, and an English Translation of the Office Action. (5 pages).

Office Action (Notice of Reasons for Rejection) issued Feb. 25, 2014, by the Japanese Patent Office in corresponding Japanese Patent Application No. 2011-537031, and an English Translation of the Office Action. (5 pages).

Chinese Office Action issued in corresponding Chinese Patent Appln. No. 200980162016.X, dated May 6, 2014, with English translation (13 pages).

Japanese Office Action dated Jul. 8, 2014 issued in corresponding Japanese Patent Appln. No. 2011-537031, with English translation (2 pages).

* cited by examiner

HEAT MEDIUM RELAY UNIT AND AIR-CONDITIONING APPARATUS

TECHNICAL FIELD

The present invention relates to a heat medium relay unit disposed between an outdoor unit and indoor units and to an air-conditioning apparatus including the same, and in particular to a heat medium relay unit and an air-conditioning apparatus in which the heat medium relay unit has a simplified piping configuration, reduced size, and improved serviceability.

BACKGROUND ART

In an air-conditioning apparatus such as a multi-air-conditioning apparatus intended for multistory buildings, refrigerant is made to circulate between, for example, an outdoor unit that is a heat source unit provided outside the building and indoor units provided in rooms of the building. As the refrigerant transfers or receives heat, air is heated or cooled, whereby heating or cooling conditioned space. Refrigerants such as HFC (hydrofluorocarbon) refrigerant are frequently used. Further, apparatus using natural refrigerant such as carbon dioxide ($CO_2$) have also been proposed.

In an air-conditioning apparatus called a chiller, a heat source unit provided outside a building generates cooling energy or heating energy; a heat exchanger provided in an outdoor unit heats or cools water, antifreeze, or the like; and the heated or cooled water, antifreeze, or the like is conveyed to indoor units such as fan coil units or panel heaters, whereby cooling or heating is performed (see Patent Literature 1, for example).

There is another apparatus called a heat recovery chiller in which four water pipes connect a heat source unit with each indoor unit, and cooled water or the like and heated water or the like are supplied simultaneously, whereby making cooling or heating arbitrarily selectable in each of the indoor units (see Patent Literature 2, for example).

There is yet another apparatus that provides heat exchangers for a primary refrigerant and a secondary refrigerant near respective indoor units, in which the secondary refrigerant is conveyed to the indoor units (see Patent Literature 3, for example).

There is still yet another apparatus that connects an outdoor unit and branch units with heat exchangers to each other with two pipes, in which a secondary refrigerant is conveyed to the indoor units (see Patent Literature 4, for example).

CITATION LIST

Patent Literature

Patent Literature 1: Japanese Unexamined Patent Application Publication No. 2005-140444 (p. 4, FIG. 1, etc.)

Patent Literature 2: Japanese Unexamined Patent Application Publication No. 5-280818 (pp. 4 and 5, FIG. 1, etc.)

Patent Literature 3: Japanese Unexamined Patent Application Publication No. 2001-289465 (pp. 5 to 8, FIGS. 1 and 2, etc.)

Patent Literature 4: Japanese Unexamined Patent Application Publication No. 2003-343936 (p. 5, FIG. 1, etc.)

SUMMARY OF INVENTION

Technical Problem

In a conventional air-conditioning apparatus such as a multi-air-conditioning apparatus intended for multistory buildings, a refrigerant is made to circulate through indoor units, and the refrigerant may therefore leak out into a room or the like. In contrast, in such air-conditioning apparatus disclosed in Patent Literature 1 and Patent Literature 2, the refrigerant does not flow through the indoor units. However, in the air-conditioning apparatus disclosed in Patent Literature 1 and Patent Literature 2, a heat medium needs to be heated or cooled in the heat source unit provided outside the building and be conveyed to the indoor units side. Therefore, the flow path through which the heat medium circulates is long. In this case, the conveyance of heat with the heat medium for a certain heating or cooling work consumes larger amount of energy in the form of conveyance power or the like than that of the refrigerant. Hence, when the circulation path becomes long, the conveyance power becomes very large. This shows that, in an air-conditioning apparatus, energy can be saved if the circulation of the heat medium can be appropriately controlled.

In the air-conditioning apparatus disclosed in Patent Literature 2, four pipes are necessary to connect the outdoor side with each room to enable selection of cooling or heating in each indoor unit, and thus leading to difficulty of construction. In the air-conditioning apparatus disclosed in Patent Literature 3, secondary-medium-circulating means such as a pump needs to be provided for each indoor unit. Therefore, the apparatus is not only expensive but generates loud noise, and is unpractical. Moreover, since the heat exchangers are provided near the indoor units, risk of leakage of the refrigerant near a room cannot be eliminated.

In the air-conditioning apparatus disclosed in Patent Literature 4, since the primary refrigerant after heat exchange flows into the same flow path as that for the primary refrigerant before heat exchange, when a plurality of indoor units are connected, none of the indoor units could exert its maximum capacity, resulting in an energy-wasting configuration. Moreover, each branch unit is connected to a total of four extension pipes including two for cooling and two for heating. Such a configuration is substantially the same as a system in which an outdoor unit and branch units are connected to each other with four pipes, resulting in difficulty of construction.

In this respect, there is yet another apparatus in which a heat medium relay unit responsible for refrigerant-water heat exchange and the like is provided between an outdoor unit and the indoor units, and in which the power to convey water is suppressed. In this apparatus, the heat medium relay unit does not directly contribute to air conditioning of the conditioned space. Furthermore, considering safety from refrigerant leakage and the like, the heat medium relay unit is presumed to be provided in a space where there are many restrictions, such as a space above a ceiling, and to be connected to each indoor unit on each floor with pipes. Therefore, a simple and compact piping configuration is desirable. Particularly, in terms of compactness, the heat medium relay unit is desired to be thin so as to be suitable for an environment with severe restrictions in one direction, for example, the height direction.

Note that the heat medium relay unit, at times, deals cooling energy and heating energy simultaneously. Therefore, just downsizing the heat medium relay unit may lead to pipes used for cooling energy and pipes used for heating energy to become close to each other. If pipes used for cooling energy and pipes used for heating energy are positioned closed to each other, energy efficiency is reduced. Therefore, the piping of the apparatus needs to be configured with much consideration. Consideration to improve serviceability is needed so that maintenance work including repair and service can be easily performed by a worker. It is presumed that the heat medium relay unit is provided in a space having restrictions. Therefore, by improving serviceability, an apparatus that is more convenient and useful can be provided.

The present invention is directed to solve the above problems and an object is to provide a heat medium relay unit and an air-conditioning apparatus or the like achieving downsizing while saving energy with improved serviceability.

Solution to Problem

A heat medium relay unit according to the invention forms part of an air-conditioning apparatus including at least a compressor, a heat source side heat exchanger, a plurality of expansion devices, a plurality of heat exchangers related to heat medium, a plurality of heat medium delivering devices, a plurality of heat medium flow switching devices, a plurality of heat medium flow control devices, and a plurality of use side heat exchangers. The plurality of expansion devices, the plurality of heat exchangers related to heat medium, the plurality of heat medium delivering devices, the plurality of heat medium flow control devices, and the plurality of heat medium flow switching devices are housed in a housing. The heat medium delivering devices, the heat medium flow control devices, and the heat medium flow switching devices are provided so as to be detachable from a specific side of the housing.

An air-conditioning apparatus according to the invention includes the above heat medium relay unit. The compressor, the heat source side heat exchanger, the plurality of expansion devices, and the plurality of heat exchangers related to heat medium are connected to one another and form a refrigerant circulation circuit through which a heat source side refrigerant is made to circulate. The plurality of heat medium delivering devices, the plurality of heat medium flow switching devices, the plurality of use side heat exchangers, and the plurality of heat exchangers related to heat medium are connected to one another and form a heat medium circulation circuit through which a heat medium is made to circulate. The compressor and the heat source side heat exchanger are housed in an outdoor unit. The use side heat exchangers are housed in indoor units.

Advantageous Effects of Invention

The heat medium relay unit and the air-conditioning apparatus according to the invention provides the heat medium delivering devices and the heat medium flow switching devices so as to be detachable from a specific side (for example, a servicing side), and is capable of improving serviceability.

DESCRIPTION OF EMBODIMENTS

Embodiment of the invention will now be described with reference to the Drawings.

Figure 1:
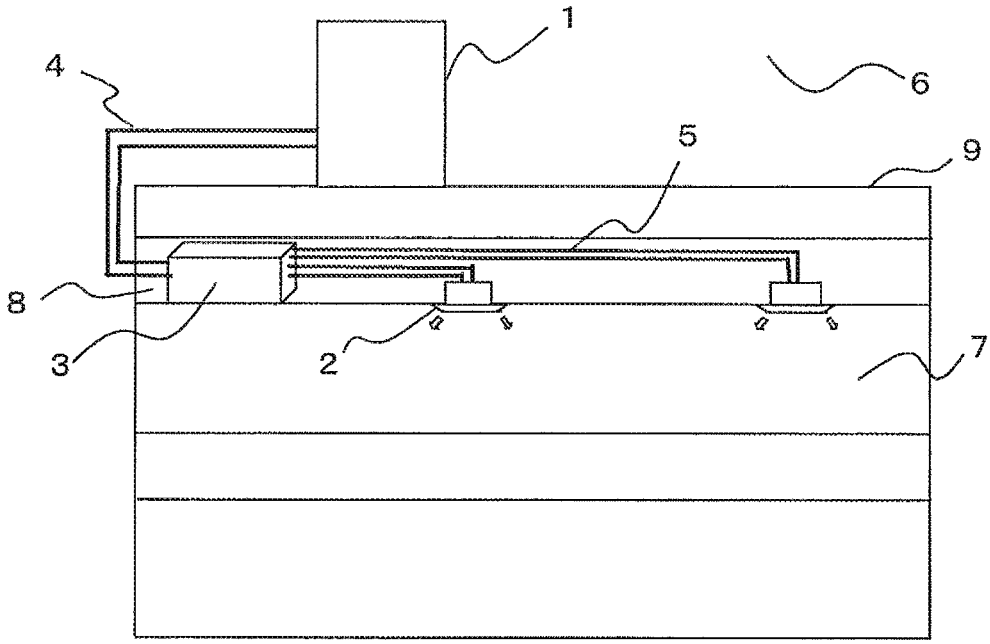
FIG. 1 is a schematic diagram illustrating an exemplary installation of an air-conditioning apparatus according to Embodiment of the invention.
Figure 2:
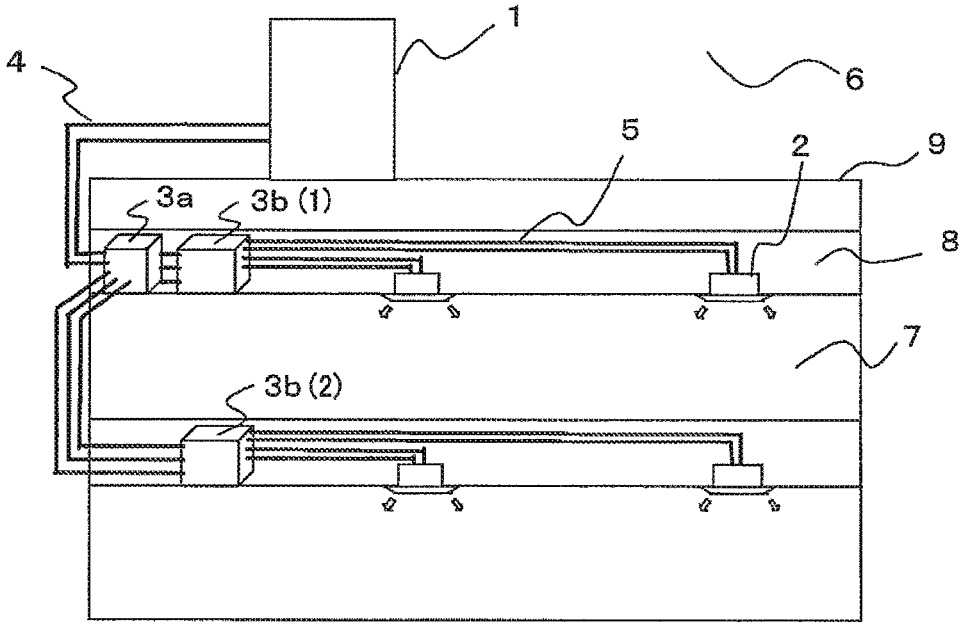
FIG. 2 is a schematic diagram illustrating another exemplary installation of an air-conditioning apparatus according to Embodiment of the invention.
Figure 3:
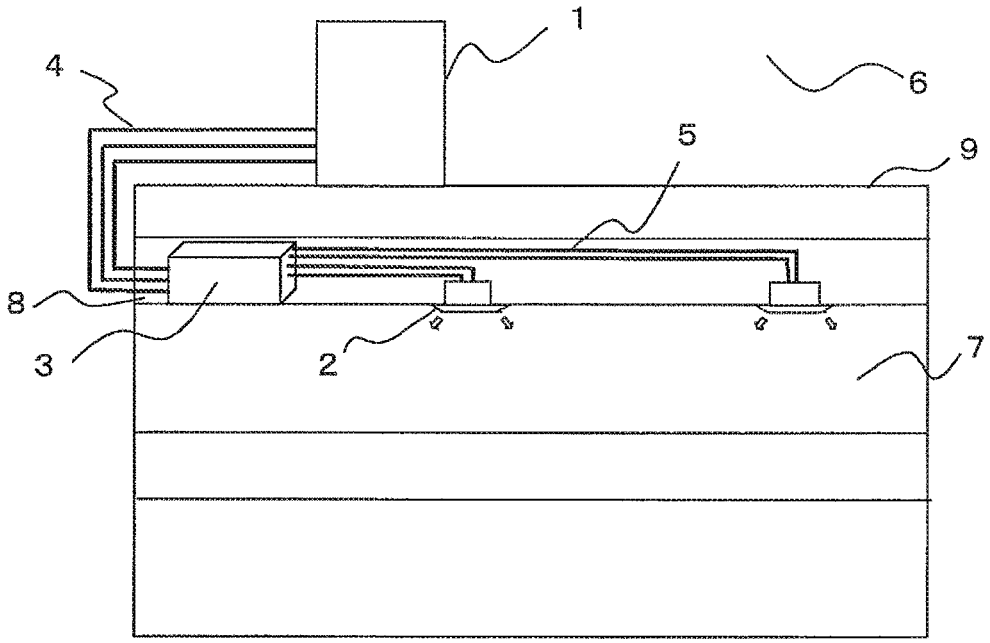
FIG. 3 is a schematic diagram illustrating yet another exemplary installation of an air-conditioning apparatus according to Embodiment of the invention.

FIGS. 1 to 3 are schematic diagrams illustrating exemplary installations of an air-conditioning apparatus according to Embodiment of the invention. Referring to FIGS. 1 to 3, the exemplary installations of the air-conditioning apparatus will be described. In the air-conditioning apparatus, operation mode of each indoor unit is arbitrarily selectable between a cooling mode and a heating mode by utilizing refrigeration cycles (a refrigerant circulation circuit A and a heat medium circulation circuit B) through which refrigerants (a heat source side refrigerant and a heat medium) are made to circulate. In FIG. 1 and other Drawings, the sizes of individual elements do not necessarily correspond to the actual sizes thereof.

In FIG. 1, the air-conditioning apparatus according to Embodiment includes one outdoor unit 1 as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected to each other with refrigerant pipes 4 that communicate the heat source side refrigerant. The heat medium relay unit 3 and the indoor units 2 are connected to each other with pipes 5 that communicate the heat medium. Cooling energy or heating energy generated by the outdoor unit 1 is delivered to the indoor units 2 through the heat medium relay unit 3.

In FIG. 2, an air-conditioning apparatus according to Embodiment includes one outdoor unit 1, a plurality of indoor units 2, and a plurality of separate heat medium relay units 3 (a heat medium main-relay unit 3*a* and heat medium sub-relay units 3*b*) disposed between the outdoor unit 1 and the indoor units 2. The outdoor unit 1 and the heat medium main-relay unit 3*a* are connected to each other with refrigerant pipes 4. The heat medium main-relay unit 3*a* and the heat medium sub-relay units 3*b* are connected to each other with refrigerant pipes 4. The heat medium sub-relay units 3*b* and the indoor units 2 are connected to each other with pipes 5. Cooling energy or heating energy generated by the outdoor unit 1 is delivered to the indoor units 2 through the heat medium main-relay unit 3*a* and the heat medium sub-relay units 3*b*.

In FIG. 3, an air-conditioning apparatus according to Embodiment includes one outdoor unit 1, a plurality of indoor units 2, and a heat medium relay unit 3 disposed between the outdoor unit 1 and the indoor units 2. The outdoor unit 1 and the heat medium relay unit 3 are connected to each other with three refrigerant pipes 4. The heat medium relay unit 3 and the indoor units 2 are connected to each other with pipes 5 that communicate the heat medium. Cooling energy or heating energy generated by the outdoor unit 1 is delivered to the indoor units 2 through the heat medium relay unit 3.

The outdoor unit 1 is usually provided in an outdoor space 6, i.e., a space outside a building 9 such as a multistory building (for example, a rooftop), and supplies cooling energy or heating energy to the indoor units 2 through the heat medium relay unit 3. The indoor units 2 are provided at such positions that cooling air or heating air can be supplied to indoor spaces 7, i.e., spaces inside the building 9 (for example, rooms), and supply cooling air or heating air to the indoor spaces 7, i.e., conditioned spaces. The heat medium relay unit 3 is configured as a housing separate from the outdoor unit 1 and the indoor units 2 so as to be provided at a position separate from the outdoor space 6 and the indoor spaces 7. The heat medium relay unit 3 is connected to the outdoor unit 1 with the refrigerant pipes 4 and to the indoor units 2 with the pipes 5, and delivers the cooling energy or the heating energy supplied from the outdoor unit 1 to the indoor units 2.

In the air-conditioning apparatus according to Embodiment, as illustrated in FIGS. 1 and 2, the outdoor unit 1 and the heat medium relay unit 3 are connected with two refrigerant pipes 4, and the heat medium relay unit 3 and each of the indoor units 2 are connected with two pipes 5. Thus, in the air-conditioning apparatus according to Embodiment, since each unit (the outdoor unit 1, the indoor units 2, and the heat medium relay unit 3) is connected to another unit with two pipes (the refrigerant pipes 4 or the pipes 5), installation work is easy.

Alternatively, in the air-conditioning apparatus according to Embodiment, as illustrated in FIG. 3, the outdoor unit 1 and the heat medium relay unit 3 are connected with three refrigerant pipes 4, and the heat medium relay unit 3 and each of the indoor units 2 are connected with two pipes 5. Thus, in the air-conditioning apparatus according to Embodiment, since the outdoor unit 1 and the heat medium relay unit 3 are connected with three refrigerant pipes 4 and each indoor unit 2 and the heat medium relay unit 3 are connected with two pipes 5, installation work is easy. Details of this circuit will be described separately below (see FIG. 22).

As illustrated in FIG. 2, the heat medium relay unit 3 may be divided into one heat medium main-relay unit 3*a* and two heat medium sub-relay units 3*b* (a heat medium sub-relay unit 3*b*(1) and a heat medium sub-relay unit 3*b*(2)) stemming from the heat medium main-relay unit 3*a*. In this manner, a plurality of heat medium sub-relay units 3*b* can be connected to one heat medium main-relay unit 3*a*. In this configuration, the heat medium main-relay unit 3*a* is connected to each of the heat medium sub-relay units 3*b* with three refrigerant pipes 4. Details of this circuit will be described separately below (see FIG. 4).

FIGS. 1 to 3 each illustrate an exemplary case in which the heat medium relay unit 3 is provided in a space (hereinafter simply denoted as a space 8), such as above a ceiling that is inside the building 9 but is separate from the indoor spaces 7. Alternatively, the heat medium relay unit 3 may be provided in a common use space or the like where an elevator or the like is provided. Although FIGS. 1 to 3 each illustrate an exemplary case in which the indoor units 2 are of a ceiling cassette type, the indoor units 2 are not limited thereto and may be of any type, such as a ceiling concealed type or a ceiling suspended type, as long as heating air or cooling air is dischargeable to the indoor spaces 7 directly or through ducts or the like.

Although FIGS. 1 to 3 each illustrate an exemplary case in which the outdoor unit 1 is provided in the outdoor space 6, the outdoor unit 1 is not limited thereto. For example, the outdoor unit 1 may be provided in an enclosed space such as a machine room equipped with an exhaust port, or inside the building 9 if waste heat is exhaustible to the outside of the building 9 through an exhaust duct. Alternatively, if the outdoor unit 1 is of a water-cooled type, the outdoor unit 1 may be provided inside the building 9. Even if the outdoor unit 1 is provided at any of such positions, no problems in particular will arise.

The heat medium relay unit 3 may be provided near the outdoor unit 1. Nevertheless, it should be noted that, if the distance from the heat medium relay unit 3 to each indoor unit 2 is too long, the power of conveying the heat medium becomes very large and the energy saving effect is reduced. The numbers of outdoor units 1, indoor units 2, and heat medium relay units 3 to be connected are not limited to those illustrated in FIGS. 1 and 2 and may be determined on the basis of the building 9 in which the air-conditioning apparatus according to Embodiment is to be provided.

Figure 4:
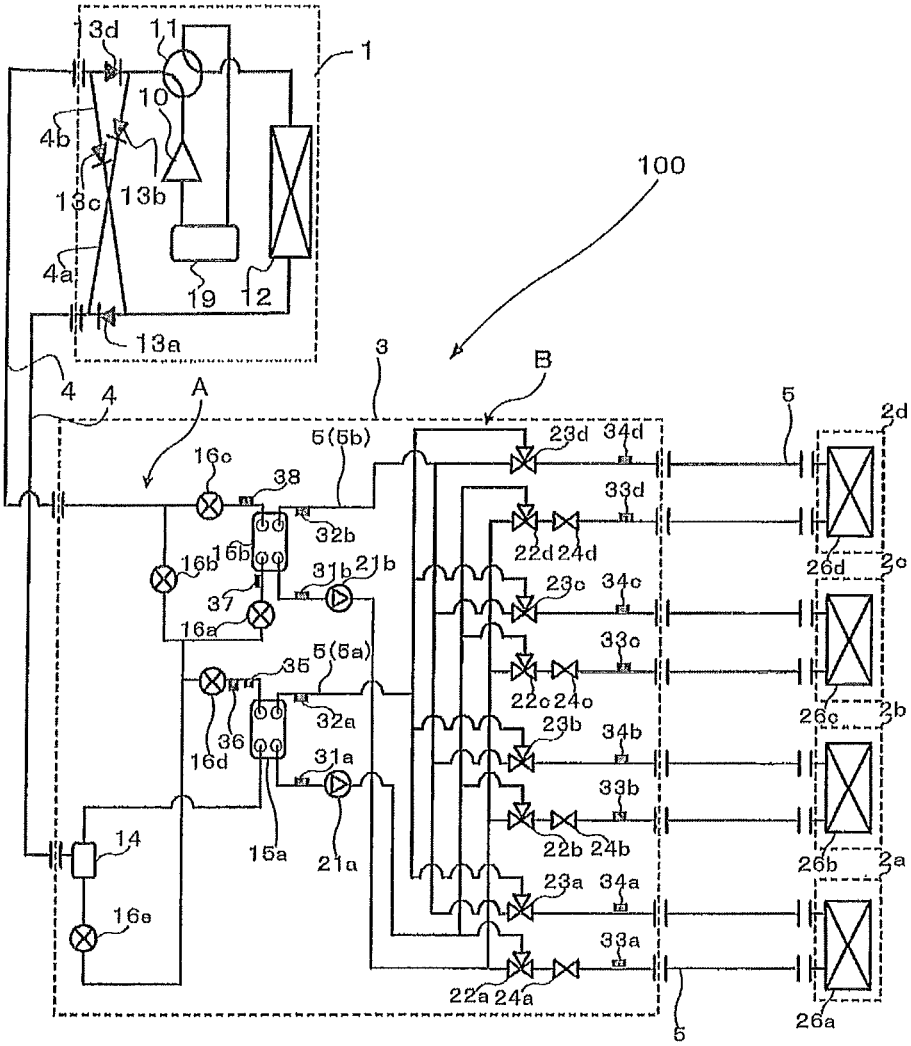
FIG. 4 is a schematic circuit diagram illustrating a configuration of an air-conditioning apparatus equipped with a heat medium relay unit according to Embodiment of the invention.

FIG. 4 is a schematic circuit diagram illustrating the configuration of an air-conditioning apparatus 100 equipped with the heat medium relay unit 3 according to Embodiment of the invention. The detailed configuration of the air-conditioning apparatus 100 will be described with reference to FIG. 4. As illustrated in FIG. 4, an outdoor unit 1 and the heat medium relay unit 3 are connected to each other through a first heat exchanger related to heat medium 15*a* and a second heat exchanger related to heat medium 15*b*. The heat medium relay unit 3 and indoor units 2 are also connected to each other through the first heat exchanger related to heat medium 15*a* and the second heat exchanger related to heat medium 15*b*.

In the air-conditioning apparatus 100, the operation mode of each of the indoor units 2 is arbitrarily selectable between a cooling mode and a heating mode by utilizing refrigeration cycles (a refrigerant circulation circuit A and a heat medium circulation circuit B) through which refrigerants (a heat source side refrigerant and a heat medium) are made to circulate. In FIG. 4, the air-conditioning apparatus 100 includes one outdoor unit 1 as a heat source unit, a plurality of indoor units 2, and the heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected to each other with refrigerant pipes 4 that communicate the heat source side refrigerant. The heat medium relay unit 3 and the indoor units 2 are connected to each other with pipes 5 that communicate the heat medium. Cooling energy or heating energy generated by the outdoor unit 1 is delivered to the indoor units 2 through the heat medium relay unit 3.

[Outdoor Unit 1]

The outdoor unit 1 is equipped with a compressor 10, a four-way valve 11 as a refrigerant flow switching device, a heat source side heat exchanger 12, and an accumulator 19 that are connected in series with refrigerant pipes 4. The outdoor unit 1 is also provided with a first connection pipe 4*a*, a second connection pipe 4*b*, a check valve 13*a*, a check valve 13*b*, a check valve 13*c*, and a check valve 13*d*. By providing the first connection pipe 4*a*, the second connection pipe 4*b*, the check valve 13*a*, the check valve 13*b*, the check valve 13*c*, and the check valve 13*d*, regardless of operations demanded by the indoor units 2, the direction of flow of the heat source side refrigerant flowing into the heat medium relay unit 3 can be made the same.

The compressor 10 sucks the heat source side refrigerant and compresses this heat source side refrigerant to a high temperature and a high pressure state. The compressor 10 may be an inverter compressor or the like capable of capacity control. The four-way valve 11 switches the flow of the heat source side refrigerant between a flow of a heating operation (in a heating only operation mode and in a heating main operation mode) and a flow of a cooling operation (in a cooling only operation mode and in a cooling main operation mode). The heat source side heat exchanger 12 functions as an evaporator in the heating operation and functions as a condenser (or a radiator) in the cooling operation. The heat source side heat exchanger 12 exchanges heat between air supplied from a non-illustrated blower such as a fan and the heat source side refrigerant, and evaporates and gasifies or condenses and liquefies the heat source side refrigerant. The accumulator 19 is provided on the suction side of the compressor 10 and stores excessive refrigerant.

The check valve 13*d* is provided in the refrigerant pipe 4 between the heat medium relay unit 3 and the four-way valve 11 and permits the heat source side refrigerant to flow only in a predetermined direction (a direction from the heat medium relay unit 3 toward the outdoor unit 1). The check valve 13*a* is provided in the refrigerant pipe 4 between the heat source side heat exchanger 12 and the heat medium relay unit 3 and permits the heat source side refrigerant to flow only in a predetermined direction (a direction from the outdoor unit 1 toward the heat medium relay unit 3). The check valve 13*b* is provided in the first connection pipe 4*a* and allows, in the heating operation, the heat source side refrigerant discharged from the compressor 10 to flow toward the heat medium relay unit 3. The check valve 13*c* is provided in the second connection pipe 4*b* and allows, in the heating operation, the heat source side refrigerant returning from the heat medium relay unit 3 to flow toward the suction side of the compressor 10.

The first connection pipe 4*a* connects, in the outdoor unit 1, the refrigerant pipe 4 between the four-way valve 11 and the check valve 13*d*, and the refrigerant pipe 4 between the check valve 13*a* and the heat medium relay unit 3. The second connection pipe 4*b* connects, in the outdoor unit 1, the refrigerant pipe 4 between the check valve 13*d* and the heat medium relay unit 3, and the refrigerant pipe 4 between the heat source side heat exchanger 12 and the check valve 13*a*. Although FIG. 4 illustrates an exemplary case in which the first connection pipe 4*a*, the second connection pipe 4*b*, the check valve 13*a*, the check valve 13*b*, the check valve 13*c*, and the check valve 13*d* are provided, the invention is not limited thereto and the foregoing elements may not necessarily be provided.

[Indoor Units 2]

Each indoor unit 2 includes a use side heat exchanger 26. Each use side heat exchanger 26 is connected by corresponding pipe 5 to corresponding heat medium flow control device 24 and corresponding second heat medium flow switching device 23, which are provided in the heat medium relay unit 3. The use side heat exchanger 26 exchanges heat between air supplied from a non-illustrated blower, such as a fan, and the heat medium, and generates heating air or cooling air to be supplied to a conditioned space.

FIG. 4 illustrates an exemplary case in which four indoor units 2 are connected to the heat medium relay unit 3, the indoor units 2 being denoted as, from the bottom of the page, an indoor unit 2*a*, an indoor unit 2*b*, an indoor unit 2*c*, and an indoor unit 2*d*. In correspondence with the indoor units 2*a* to 2*d*, the use side heat exchangers 26 are denoted as, from the bottom of the page, a use side heat exchanger 26*a*, a use side heat exchanger 26*b*, a use side heat exchanger 26*c*, and a use side heat exchanger 26*d*. The number of indoor units 2 connected is not limited to four as illustrated in FIG. 4.

[Heat Medium Relay Unit 3]

The heat medium relay unit 3 is equipped with a gas-liquid separator 14, an expansion device 16*e*, two heat exchangers related to heat medium 15 (the first heat exchanger related to heat medium 15*a* and the second heat exchanger related to heat medium 15*b*), four expansion devices 16 (expansion devices 16*a* to 16*d*), two heat medium delivering devices 21, four first heat medium flow switching devices 22, four second heat medium flow switching devices 23, and four heat medium flow control devices 24.

The gas-liquid separator 14 is connected to one of the refrigerant pipes 4 that are connected to the outdoor unit 1, and to two of the refrigerant pipes 4 that are connected to the first heat exchanger related to heat medium 15*a* and the second heat exchanger related to heat medium 15*b*, and separates the heat source side refrigerant supplied from the outdoor unit 1 into a vapor refrigerant and a liquid refrigerant. The expansion device 16*e* is provided between the gas-liquid separator 14 and a refrigerant pipe 4 connecting the expansion device 16*a* and the expansion device 16*b*, and functions as a pressure reducing valve or an expansion device. That is, the expansion device 16*e* expands the heat source side refrigerant by reducing the pressure of the heat source side refrigerant, and is controlled such that the pressure level of the refrigerant on the outlet side of the expansion device 16*e* becomes medium in a cooling and heating mixing operation. The expansion device 16*e* may be a device, such as an electronic expansion valve, whose opening degree is variably controllable.

The two heat exchangers related to heat medium 15 each function as a condenser (radiator) or an evaporator. The heat exchangers related to heat medium 15 each exchange heat between the heat source side refrigerant and the heat medium, and supply, to the indoor units 2, cooling energy or heating energy generated by the outdoor unit 1, which is stored in the heat source side refrigerant. The first heat exchanger related to heat medium 15*a* is provided in the refrigerant circulation circuit A (specifically, the flow of the vapor refrigerant) and between the gas-liquid separator 14 and the expansion device 16*d*. The second heat exchanger related to heat medium 15*b* is provided in the refrigerant circulation circuit A and between the expansion device 16*a* and the expansion device 16*c*.

The four expansion devices 16 each functions as a pressure reducing valve or an expansion valve and reduces the pressure and expands the heat source side refrigerant. The expansion device 16*a* is provided on the inlet side of the second heat exchanger related to heat medium 15*b* regarding the flow of the heat source side refrigerant. The expansion device 16*b* is provided so as to be in parallel with the expansion device 16*a* regarding the flow of the heat source side refrigerant. The expansion device 16*c* is provided on the outlet side of the second heat exchanger related to heat medium 15*b* regarding the flow of the heat source side refrigerant. The expansion device 16*d* is provided on the outlet side of the first heat exchanger related to heat medium 15*a* regarding the flow of the heat source side refrigerant. The four expansion devices 16 may be devices, such as an electronic expansion valve, whose opening degree is variably controllable.

The two heat medium delivering devices 21 (a first heat medium delivering device 21*a* and a second heat medium delivering device 21*b*) are pumps or the like and pressurize the heat medium communicating through the pipes 5 and circulate the heat medium. The first heat medium delivering device 21*a* is provided in a pipe 5 between the first heat exchanger related to heat medium 15*a* and the heat medium flow switching devices 22. The second heat medium delivering device 21*b* is provided in a pipe 5 between the second heat exchanger related to heat medium 15*b* and the heat medium flow switching devices 22. The first heat medium delivering device 21*a* and the second heat medium delivering device 21*b* are not limited to be of particular types and may each be, for example, a capacity-controllable pump.

The four first heat medium flow switching devices 22 (the first heat medium flow switching devices 22*a* to 22*d*) are three-way valves and switch the flow path of the heat medium. The number (herein, four) of first heat medium flow switching devices 22 corresponds to the number of indoor units 2 provided. Each of the first heat medium flow switching devices 22 has one of the three ways thereof connected to the first heat exchanger related to heat medium 15*a*, another of the three ways thereof connected to the second heat exchanger related to heat medium 15*b*, and the remainder of the three ways thereof connected to a corresponding one of the heat medium flow control devices 24, and is provided in a heat medium flow path on the inlet side of a corresponding one of the use side heat exchangers 26. The drawing illustrates, from the bottom of the page, the first heat medium flow switching device 22*a*, the first heat medium flow switching device 22*b*, the first heat medium flow switching device 22*c*, and the first heat medium flow switching device 22*d* in correspondence with the indoor units 2.

The four second heat medium flow switching devices 23 (second heat medium flow switching devices 23*a* to 23*d*) are three-way valves and switch the flow path of the heat medium. The number (herein, four) of second heat medium flow switching devices 23 corresponds to the number of indoor units 2 provided. Each of the second heat medium flow switching devices 23 has one of the three ways thereof connected to the first heat exchanger related to heat medium 15*a*, another of the three ways thereof connected to the second heat exchanger related to heat medium 15*b*, and the remainder of the three ways thereof connected to a corresponding one of the use side heat exchangers 26, and is provided in a heat medium flow path on the outlet side of the corresponding use side heat exchanger 26. The drawing illustrates, from the bottom of the page, the second heat medium flow switching device 23*a*, the second heat medium flow switching device 23*b*, the second heat medium flow switching device 23*c*, and the second heat medium flow switching device 23*d* in correspondence with the indoor units 2.

The four heat medium flow control devices 24 (heat medium flow control devices 24*a* to 24*d*) are two-way valves including, for example, a stepping motor and are each capable of changing the opening degree of a corresponding one of the pipes 5 serving as heat medium flow paths, thereby controlling the flow rate of the heat medium. The number (herein, four) of heat medium flow control devices 24 corresponds to the number of indoor units 2 provided. Each of the heat medium flow control devices 24 has one way thereof connected to a corresponding one of the use side heat exchangers 26, and the other way thereof connected to a corresponding one of the first heat medium flow switching devices 22, and is provided in the heat medium flow path on the inlet side of the corresponding use side heat exchanger 26. The drawing illustrates, from the bottom of the page, the heat medium flow control device 24*a*, the heat medium flow control device 24*b*, the heat medium flow control device 24*c*, and the heat medium flow control device 24*d* in correspondence with the indoor units 2. Alternatively, each heat medium flow control device 24 may be provided in the heat medium flow path on the outlet side of the corresponding use side heat exchanger 26.

The heat medium relay unit 3 also is provided with two first heat medium temperature detecting means (first temperature sensors) 31, two second heat medium temperature detecting means (second temperature sensors) 32, four third heat medium temperature detecting means (third temperature sensors) 33, four fourth heat medium temperature detecting means (fourth temperature sensors) 34, first refrigerant temperature detecting means (a first refrigerant temperature sensor) 35, refrigerant-pressure-detecting means (a pressure sensor) 36, second refrigerant temperature detecting means (a second refrigerant temperature sensor) 37, and third refrigerant temperature detecting means (a third refrigerant temperature sensor) 38. Information detected by these detecting means are transmitted to a non-illustrated control device controlling the operation of the air-conditioning apparatus 100 and are used in controlling the driving frequencies of the compressor 10 and the heat medium delivering devices 21, the switching of the flow path of the heat medium flowing through the pipes 5, and so forth.

The two first temperature sensors 31 (a first temperature sensor 31*a* and a first temperature sensor 31*b*) detect the temperatures of the heat medium flowing out of the heat exchangers related to heat medium 15, i.e., the temperatures of the heat medium at the outlets of the respective heat exchangers related to heat medium 15, and may be, for example, thermistors. The first temperature sensor 31*a* is provided in the pipe 5 on the inlet side of the first heat medium delivering device 21*a*. The first temperature sensor 31*b* is provided in the pipe 5 on the inlet side of the second heat medium delivering device 21*b*.

The two second temperature sensors 32 (a second temperature sensor 32*a* and a second temperature sensor 32*b*) detect the temperatures of the heat medium flowing into the heat exchangers related to heat medium 15, i.e., the temperatures of the heat medium at the inlets of the respective heat exchangers related to heat medium 15, and may be, for example, thermistors. The second temperature sensor 32*a* is provided in the pipe 5 on the inlet side of the first heat exchanger related to heat medium 15*a*. The second temperature sensor 32*b* is provided in the pipe 5 on the inlet side of the second heat exchanger related to heat medium 15*b*.

The four third temperature sensors 33 (third temperature sensors 33*a* to 33*d*) are provided in the heat medium flow paths on the inlet sides of the respective use side heat exchangers 26 and detect the temperatures of the heat medium flowing into the respective use side heat exchangers 26. The third temperature sensors 33 may be thermistors or the like. The number (herein, four) of third temperature sensors 33 corresponds to the number of indoor units 2 provided. The drawing illustrates, from the bottom of the page, the third temperature sensor 33*a*, the third temperature sensor 33*b*, the third temperature sensor 33*c*, and the third temperature sensor 33*d* in correspondence with the indoor units 2.

The four fourth temperature sensors 34 (fourth temperature sensors 34*a* to 34*d*) are provided in the heat medium flow paths on the outlet sides of the respective use side heat exchangers 26 and detect the temperatures of the heat medium flowing out of the use side heat exchangers 26. The fourth temperature sensors 34 may be thermistors or the like. The number (herein, four) of fourth temperature sensors 34 corresponds to the number of indoor units 2 provided. The drawing illustrates, from the bottom of the page, the fourth temperature sensor 34*a*, the fourth temperature sensor 34*b*, the fourth temperature sensor 34*c*, and the fourth temperature sensor 34*d* in correspondence with the indoor units 2.

The first refrigerant temperature sensor 35 is provided in the refrigerant circulation circuit A and on the outlet side of the first heat exchanger related to heat medium 15*a*, and detects the temperature of the heat source side refrigerant flowing out of the first heat exchanger related to heat medium 15*a*. The first refrigerant temperature sensor 35 may be a thermistor or the like. The pressure sensor 36 is provided in the refrigerant circulation circuit A and on the outlet side of the first heat exchanger related to heat medium 15*a*, and detects the pressure of the heat source side refrigerant flowing out of the first heat exchanger related to heat medium 15*a*. The pressure sensor 36 may be a pressure sensor or the like.

The second refrigerant temperature sensor 37 is provided in the refrigerant circulation circuit A and on the inlet side of the second heat exchanger related to heat medium 15*b*, and detects the temperature of the heat source side refrigerant flowing into the second heat exchanger related to heat medium 15*b*. The second refrigerant temperature sensor 37 may be a thermistor or the like. The third refrigerant temperature sensor 38 is provided in the refrigerant circulation circuit A and on the outlet side of the second heat exchanger related to heat medium 15*b*, and detects the temperature of the heat source side refrigerant flowing out of the second heat exchanger related to heat medium 15*b*. The third refrigerant temperature sensor 38 may be a thermistor or the like.

The pipes 5 communicating the heat medium include pipes connected to the first heat exchanger related to heat medium 15*a* (hereinafter denoted as pipes 5*a*) and pipes connected to the second heat exchanger related to heat medium 15*b* (hereinafter denoted as pipes 5*b*). The pipes 5*a* and the pipes 5*b* each branch (herein, four branches) in correspondence with the number of indoor units 2 connected to the heat medium relay unit 3. The pipes 5*a* and the pipes 5*b* are connected to each other at the respective first heat medium flow switching devices 22 and the respective second heat medium flow switching devices 23. Controlling of the first heat medium flow switching devices 22 and the second heat medium flow switching devices 23 determines which of the heat medium communicating through the pipes 5*a* and the heat medium communicating through the pipes 5*b* is allowed to flow into the use side heat exchangers 26.

In the air-conditioning apparatus 100, the compressor 10, the four-way valve 11, the heat source side heat exchanger 12, the first heat exchanger related to heat medium 15*a*, and the second heat exchanger related to heat medium 15*b* are connected with the refrigerant pipes 4 in series in the above order, thereby forming the refrigerant circulation circuit A. Furthermore, the first heat exchanger related to heat medium 15*a*, the first heat medium delivering device 21*a*, and each of the use side heat exchangers 26 are connected with the pipes 5*a* in series in the above order, thereby constituting a portion of the heat medium circulation circuit B. In the same way, the second heat exchanger related to heat medium 15*b*, the second heat medium delivering device 21*b*, and each of the use side heat exchangers 26 are connected with the pipes 5*b* in series in the above order, thereby constituting a portion of the heat medium circulation circuit B. That is, a plurality of use side heat exchangers 26 connected in parallel are connected to each of the heat exchangers related to heat medium 15. Accordingly, the heat medium circulation circuit B includes a plurality of cycles.

That is, the outdoor unit 1 and the heat medium relay unit 3 are connected to each other through the first heat exchanger related to heat medium 15*a* and the second heat exchanger related to heat medium 15*b* provided in the heat medium relay unit 3, and the heat medium relay unit 3 and the indoor units 2 are connected to each other through the first heat exchanger related to heat medium 15*a* and the second heat exchanger related to heat medium 15*b*, whereby the first heat exchanger related to heat medium 15*a* and the second heat exchanger related to heat medium 15*b* each exchange heat between the heat source side refrigerant on a primary side circulating through the refrigerant circulation circuit A and the heat medium, i.e., the refrigerant such as water or antifreeze, on a secondary side circulating through the heat medium circulation circuit B.

The non-illustrated control device is a microprocessor or the like and controls, on the basis of detection information from the individual detecting means and instructions from a remote controller, the driving frequency of the compressor 10, the rotation speed (including the ON/OFF operation) of the blower, the switching of the four-way valve 11, the driving of the heat medium delivering devices 21, the opening degrees of the expansion devices 16, the switching of the first heat medium flow switching devices 22, the switching of the second heat medium flow switching devices 23, the driving of the heat medium flow control devices 24, and so forth, and achieves operations of different modes described separately below. The control device may be provided for each unit, or may be provided in the outdoor unit 1 or the heat medium relay unit 3.

Now, the types of refrigerants used in the refrigerant circulation circuit A and the heat medium circulation circuit B will be described. In the refrigerant circulation circuit A, for example, a non azeotropic refrigerant mixture such as R407c, a near-azeotropic refrigerant mixture such as R410A, a single component refrigerant such as R22 may be used. Alternatively, natural refrigerant such as carbon dioxide or hydrocarbon may be used. If a natural refrigerant is used as the heat source side refrigerant, the greenhouse effect on Earth due to leakage of the refrigerant is advantageously suppressed.

The heat medium circulation circuit B is connected to the use side heat exchangers 26 of the indoor units 2, as described above. Therefore, the air-conditioning apparatus 100 is based on an assumption that a highly safe heat medium is used, in case that the heat medium should leak out in rooms or the like in which the indoor units 2 are provided. Hence, the heat medium used may be, for example, water, antifreeze, or a mixture of water and antifreeze. With such a configuration, leakage of the refrigerant due to freezing or corrosion can be suppressed even at low outdoor temperatures, achieving high reliability. Furthermore, if the indoor units 2 are provided in places, such as computer rooms, in which humidity is unfavorable, highly insulating inert fluorine liquid may be used as the heat medium.

Operation modes that the air-conditioning apparatus 100 undergoes will be described. The air-conditioning apparatus 100 can undergo a cooling operation or a heating operation in each of the indoor units 2 in accordance with instructions from the indoor units 2. That is, the air-conditioning apparatus 100 allows all of the indoor units 2 to perform the same operation and also allows the indoor units 2 to individually perform different operations. There are four operation modes that the air-conditioning apparatus 100 undergoes are a cooling only operation mode in which all of the indoor units 2 that are being driven perform cooling operations, a heating only operation mode in which all of the indoor units 2 that are being driven perform heating operations, a cooling main operation mode in which the cooling load is the larger, and a heating main operation mode in which the heating load is the larger. Among these operation modes, the cooling main operation mode will be described in which cooling and heating operations are mixed and the cooling load is dominant.

[Cooling Main Operation Mode]

Figure 5:
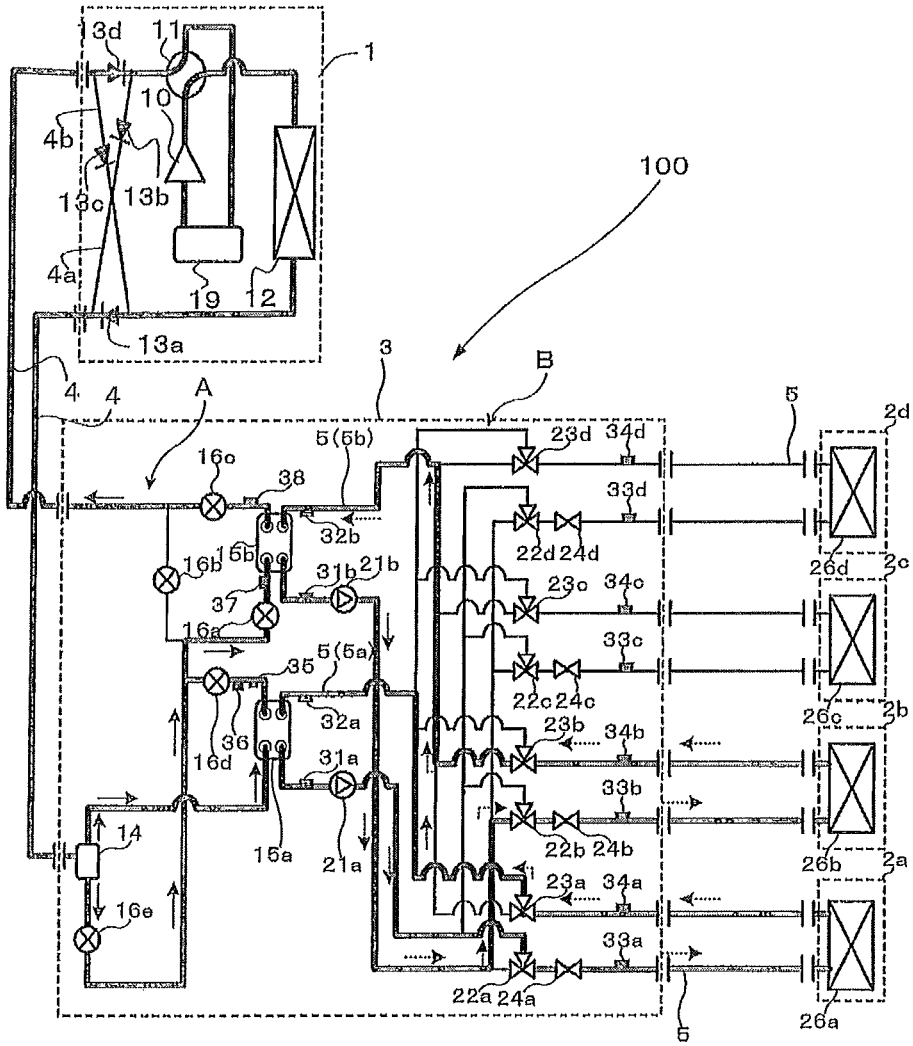
FIG. 5 is a refrigerant circuit diagram illustrating the flow of a refrigerant when an air-conditioning apparatus according to Embodiment of the invention is in a cooling main operation mode.

FIG. 5 is a refrigerant circuit diagram illustrating the flow of the refrigerant when the air-conditioning apparatus 100 is in the cooling main operation mode. Referring to FIG. 5, the cooling main operation mode will be described with an exemplary case in which there is a heating load in the use side heat exchanger 26*a* and a cooling load in the use side heat exchanger 26*b*. In FIG. 5, pipes represented by the bold lines are pipes through which the refrigerants (the heat source side refrigerant and the heat medium) circulate. Furthermore, the direction of flow of the heat source side refrigerant is indicated by the solid-line arrows, and the direction of flow of the heat medium is indicated by the broken-line arrows.

First, the flow of the heat source side refrigerant in the refrigerant circulation circuit A will be described.

Low temperature and low pressure refrigerant is compressed by the compressor 10 and is discharged as a high temperature and high pressure gas refrigerant. The high temperature and high pressure gas refrigerant that has been discharged from the compressor 10 flows through the four-way valve 11 and into the heat source side heat exchanger 12. In the heat source side heat exchanger 12, the gas refrigerant is condensed by transferring its heat to the outdoor air and is turned into a two-phase gas-liquid refrigerant. The two-phase gas-liquid refrigerant that has flowed out of the heat source side heat exchanger 12 flows through the check valve 13*a* and out of the outdoor unit 1 and flows through the refrigerant pipe 4 into the heat medium relay unit 3. The two-phase gas-liquid refrigerant that has flowed into the heat medium relay unit 3 flows into the gas-liquid separator 14 and is separated into a gas refrigerant and a liquid refrigerant.

The gas refrigerant separated in the gas-liquid separator 14 flows into the first heat exchanger related to heat medium 15*a* functioning as a condenser. The gas refrigerant that has flowed into the first heat exchanger related to heat medium 15*a* is condensed and liquefied while transferring its heat to the heat medium circulating through the heat medium circulation circuit B, thereby turning into a liquid refrigerant. The liquid refrigerant that has flowed out of the first heat exchanger related to heat medium 15*a* flows through the expansion device 16*d*.

Meanwhile, the liquid refrigerant separated in the gas-liquid separator 14 flows through the expansion device 16*e* and merges with the liquid refrigerant that has been condensed and liquefied in the first heat exchanger related to heat medium 15*a* and has flowed through the expansion device 16*d*. The merged refrigerant is throttled and expanded by the expansion device 16*a*, thereby turning into a low temperature and low pressure, two-phase gas-liquid refrigerant and flows into the second heat exchanger related to heat medium 15*b*. In the second heat exchanger related to heat medium 15*b* functioning as an evaporator, the two-phase gas-liquid refrigerant cools the heat medium by receiving heat from the heat medium circulating through the heat medium circulation circuit, thereby turning into a low temperature and low pressure gas refrigerant.

The gas refrigerant that has flowed out of the second heat exchanger related to heat medium 15*b* flows through the expansion device 16*c* and out of the heat medium relay unit 3 and flows through the refrigerant pipe 4 into the outdoor unit 1. The refrigerant that has flowed into the outdoor unit 1 flows through the check valve 13*d*, the four-way valve 11, and the accumulator 19, and is sucked into the compressor 10 again. The opening degree of the expansion device 16*b* is set to a small degree so as not to allow the refrigerant to flow therethrough, whereas the expansion device 16*c* is fully open so that there is no pressure loss.

Now, the flow of the heat medium in the heat medium circulation circuit B will be described.

The heat medium that has been pressurized by and has flowed out of the first heat medium delivering device 21*a* flows through the first heat medium flow switching device 22*a* and the heat medium flow control device 24*a* into the use side heat exchanger 26*a*. Then, in the use side heat exchanger 26*a*, the heat medium provides its heat to the indoor air, whereby the conditioned space, such as a room, where the indoor unit 2 is installed is heated. Meanwhile, the heat medium that has been pressurized by and has flowed out of the second heat medium delivering device 21*b* flows through the first heat medium flow switching device 22*b* and the heat medium flow control device 24*b* into the use side heat exchanger 26*b*. Then, in the use side heat exchanger 26*b*, the heat medium receives heat from the indoor air, whereby the conditioned space, such as a room, where the indoor unit 2 is installed is cooled.

The heat medium flow control device 24*a* functions such that the heat medium used in the heating operation flows to the use side heat exchanger 26*a* at a flow rate required to cover the air conditioning load demanded in the conditioned space. The heat medium that has been used for the heating operation flows through the second heat medium flow switching device 23*a* into the first heat exchanger related to heat medium 15*a* and is sucked into the first heat medium delivering device 21*a* again.

The heat medium flow control device 24*b* functions such that the heat medium used in the cooling operation flows to the use side heat exchanger 26*b* at a flow rate required to cover the air conditioning load demanded in the conditioned space. The heat medium that has been used for the cooling operation flows through the second heat medium flow switching device 23*b* into the second heat exchanger related to heat medium 15*b* and is sucked into the second heat medium delivering device 21*b* again.

The heat medium relay unit 3 according to Embodiment includes a plurality of first heat medium flow switching devices 22, a plurality of second heat medium flow switching devices 23, and a plurality of heat medium flow control devices 24. If the first heat medium flow switching devices 22, the second heat medium flow switching devices 23, and the heat medium flow control devices 24 are individually connected to one another with pipes, the pipe arrangement becomes complicated, resulting in an increase in the size of the heat medium relay unit 3. Accordingly, the valves (a first heat medium flow switching device 22, a second heat medium flow switching device 23, and a heat medium flow control device 24) are provided in the form of a block (hereinafter referred to as valve block) and simplifying the pipe arrangement, whereby the size of the heat medium relay unit 3 is reduced. Note that the valves are not limited to be provided in the form of a valve block (see FIG. 15).

Figure 6:
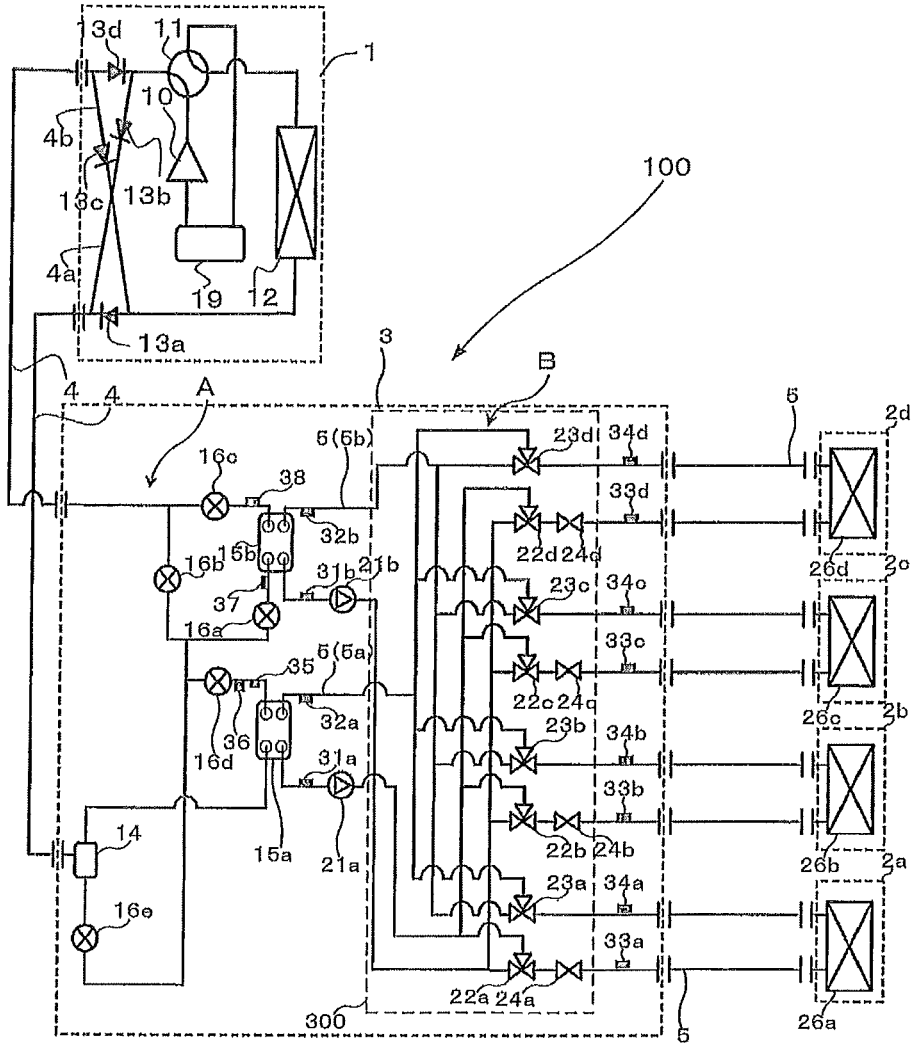
FIG. 6 is a refrigerant circuit diagram illustrating the schematic configuration of a valve block unit included in an air-conditioning apparatus according to Embodiment of the invention.

FIG. 6 is a refrigerant circuit diagram illustrating the schematic configuration of a valve block unit 300 in the air-conditioning apparatus 100. Referring to FIG. 6, the configuration of the valve block unit 300 will be described. In Embodiment, portion of the heat medium relay unit 3 surrounded by the broken line in FIG. 6 is provided in the form of a block and is constituted as the valve block unit 300.

As can be seen from FIG. 6, the valve block unit 300 includes the first heat medium flow switching devices 22, the second heat medium flow switching devices 23, the heat medium flow control devices 24, a cooling main supply pipe 307, a heating main supply pipe 308, a cooling main return pipe 305, a heating main return pipe 306, first branch pipes 301, and second branch pipes 302. The cooling main supply pipe 307, the heating main supply pipe 308, the cooling main return pipe 305, the heating main return pipe 306, the first branch pipes 301, and the second branch pipes 302 each constitutes a portion of the above-described pipes 5. The first branch pipes 301 constitutes flow paths that direct the heat medium toward the load side (indoor units 2), and the second branch pipes 302 constitutes flow paths through which the heat medium returns from the load side (indoor units 2).

Figure 7:
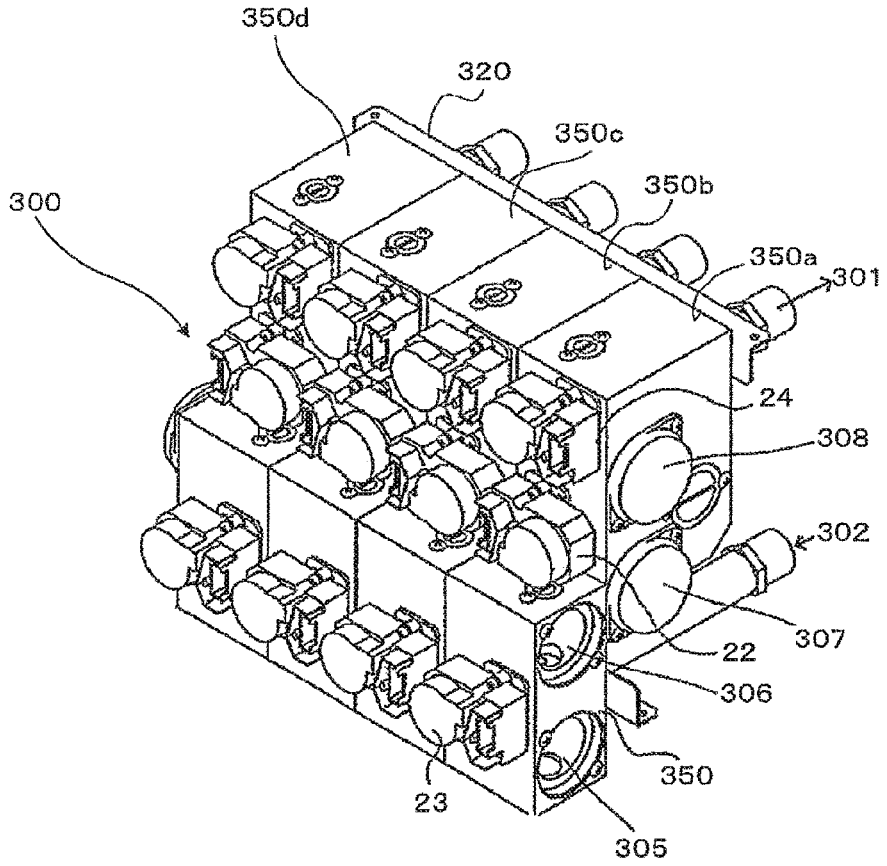
FIG. 7 is a perspective view illustrating the detailed configuration of a valve block unit.

FIG. 7 is a perspective view illustrating the detailed configuration of the valve block unit 300. Referring to FIG. 7, the configuration of the valve block unit 300 will be described in more detail. The valve block unit 300 illustrated in FIG. 7 is configured such that, as illustrated in FIG. 7, four valve blocks 350 (valve blocks 350*a* to 350*d*) are connected together and are coupled to the four respective indoor units 2. Each of the valve blocks 350 includes a first heat medium flow switching device 22, a second heat medium flow switching device 23, and a heat medium flow control device 24 and is thus responsible for one branch.

Figure 8:
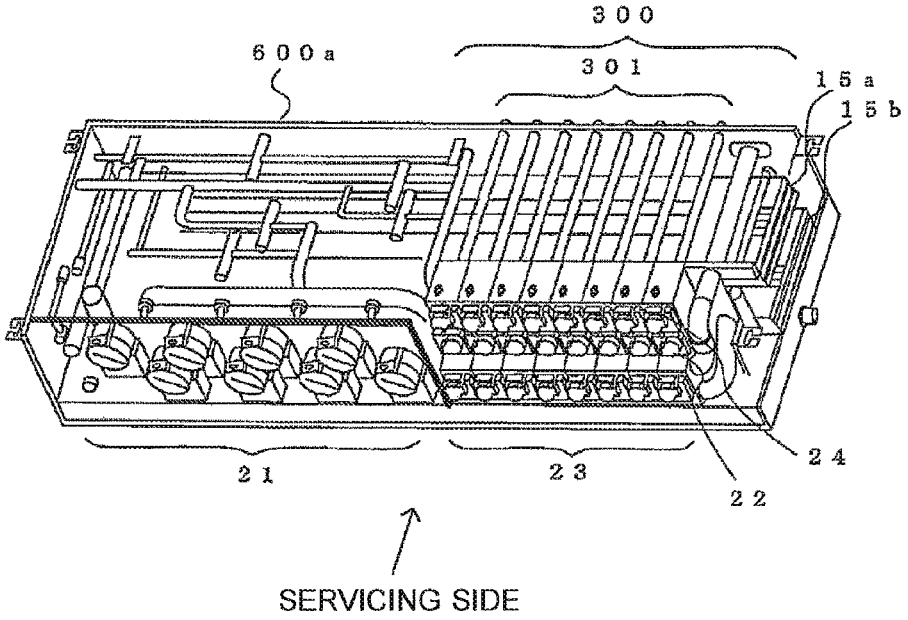
FIG. 8 is a schematic diagram illustrating the internal configuration of a heat medium relay unit equipped with a valve block unit.

That is, FIG. 7 illustrates a case where the valve block unit 300 according to Embodiment includes four branches. Furthermore, each of the main pipes (the cooling main supply pipe 307, the heating main supply pipe 308, the cooling main return pipe 305, and the heating main return pipe 306) are connected together by connecting means 320. FIG. 8 described below illustrates an exemplary case in which the valve block unit 300 includes eight branches. The first heat medium flow switching devices 22 each include at least valve body rotating means and a valve body that are not illustrated. The second heat medium flow switching devices 23 also each include at least valve body rotating means and a valve body that are not illustrated. The heat medium flow control devices 24 also each include at least valve body rotating means and a valve body that are not illustrated.

The valve body rotating means included in the first heat medium flow switching devices 22, the second heat medium flow switching devices 23, and the heat medium flow control devices 24 are, for example, stepping motors and can be driven by supplying pulse signals thereto from the non-illustrated controlling means. Instead of stepping motors, other motors such as geared motors may alternatively be employed as the valve body rotating means.

FIG. 8 is a schematic diagram illustrating the internal configuration of the heat medium relay unit 3 equipped with the valve block unit 300. Referring to FIG. 8, the internal configuration of the heat medium relay unit 3 will be described. FIG. 8 illustrates the exemplary case where the valve block unit 300 includes eight branches. In FIG. 8, the near side of the page corresponds to a servicing side (a side on which a worker performs repair and maintenance work) of the heat medium relay unit 3. FIG. 8 also illustrates a housing 600 of the heat medium relay unit 3. The housing 600 will be described separately below by referring to FIG. 14.

The heat medium relay unit 3 equipped with the valve block unit 300 allows the heat medium to branch into eight indoor units 2. Thus, with the heat medium relay unit 3 equipped with the valve block unit 300 in which a plurality of valve blocks 350 are connected together, the devices and the pipes used for allowing the heat medium to branch into the indoor units 2 and for merging the heat medium are integrated and are thus simplified. Furthermore, the pipes in the heat medium relay unit 3 are arranged with consideration, whereby reducing the thickness of the heat medium relay unit 3.

The heat medium relay unit 3 illustrated in FIG. 8 includes eight heat medium delivering devices 21. The eight heat medium delivering devices 21 are used such that, for example, four of them serve as first heat medium delivering devices 21*a* that circulate the heat medium that has been heated in the first heat exchanger related to heat medium 15*a*, and the other four serve as second heat medium delivering devices 21*b* that circulate the heat medium that has been cooled in the second heat exchanger related to heat medium 15*b*. Although FIG. 8 illustrates the exemplary case where the heat medium relay unit 3 includes eight valve blocks 350 and eight heat medium delivering devices 21, the numbers are not limited thereto. Although not illustrated in FIG. 8, the heat medium relay unit 3 also includes the devices, instruments, and means, such as the gas-liquid separator 14 and the expansion devices 16, illustrated in FIG. 4 and other drawings.

Figure 9:
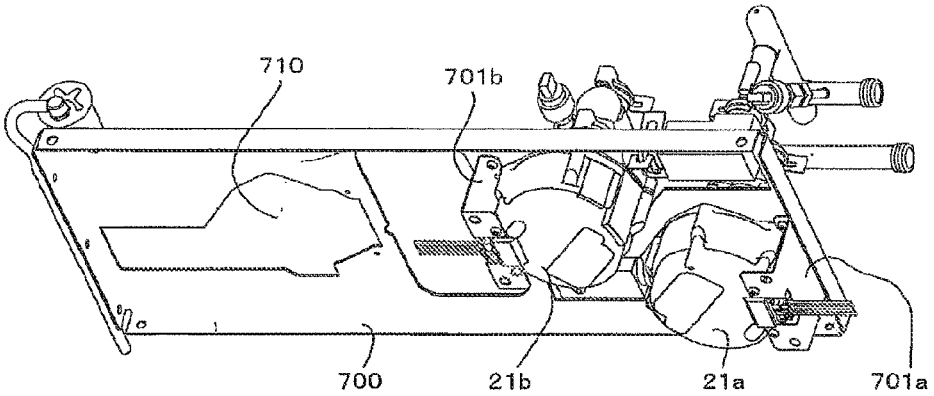
FIG. 9 is an enlarged schematic view illustrating a portion of the heat medium delivering devices illustrated in FIG. 8.
Figure 10:
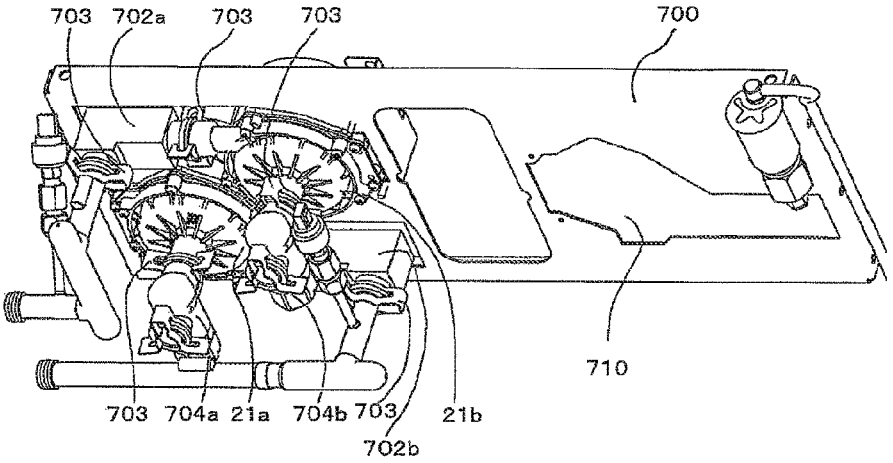
FIG. 10 is an enlarged schematic view illustrating a portion of the heat medium delivering devices illustrated in FIG. 8.

FIGS. 9 and 10 are enlarged schematic views illustrating a portion of the heat medium delivering devices 21 illustrated in FIG. 8. Referring to FIGS. 9 and 10, the arrangement of the heat medium delivering devices 21 in the heat medium relay unit 3 will be described. FIG. 9 illustrates the portion of the heat medium delivering devices 21 seen from the servicing side. FIG. 10 illustrates the portion of the heat medium delivering devices 21 seen from the side opposite the servicing side. Although FIGS. 9 and 10 each illustrate only two heat medium delivering devices 21, the heat medium delivering devices 21 each have substantially the same function except for the difference in the total flow rate. Therefore, a case in which two heat medium delivering devices 21 are provided will be described herein.

As illustrated in FIG. 9, the first heat medium delivering device 21*a* and the first heat medium delivering device 21*b* are fixed with a metal fixing plate 700, a metal fixing plate 701*a*, and a metal fixing plate 701*b*. The metal fixing plate 701*a* and the metal fixing plate 701*b* are provided on the metal fixing plate 700. The first heat medium delivering device 21*a* and the second heat medium delivering device 21*b* are each fixed at a portion of its side face to the metal fixing plate 701*a* and the metal fixing plate 701*b*, respectively. The metal fixing plate 700 has a space into which the first heat medium delivering device 21*a* and the second heat medium delivering device 21*b* are insertable. That is, the first heat medium delivering device 21*a* and the second heat medium delivering device 21*b* are inserted into the space of the metal fixing plate 700, and the first heat medium delivering device 21*a* and the second heat medium delivering device 21*b* are each fixed at a portion of its side face to the metal fixing plate 701*a* and the metal fixing plate 701*b*, respectively.

FIG. 10 illustrates an exemplary state where a strainer 704*a* and a strainer 704*b* for capturing foreign matter flowing in the heat medium circulation circuit B are provided on the suction sides of the first heat medium delivering device 21*a* and the second heat medium delivering device 21*b*, respectively. FIG. 10 also illustrates an adapter 702*a* and an adapter 702*b* for facilitating the replacement of the first heat medium delivering device 21*a* and the second heat medium delivering device 21*b*, respectively. FIG. 10 also illustrates metal members 703 that connect the heat medium delivering devices 21 and the pipes to each other so as to prevent the heat medium delivering devices 21 and the pipes 5 from being separated from each other because of hydraulic pressure. The adapters 702 (the adapter 702*a* and the adapter 702*b*) will be separately described in detail below referring to FIG. 13.

The metal fixing plate 700 illustrated in FIGS. 9 and 10 has a space 710 penetrating through the metal fixing plate 700. The space 710 serves as a space for additional heat medium delivering devices 21, (for example, if the two illustrated in FIGS. 9 and 10 are increased to three).

Figure 11:
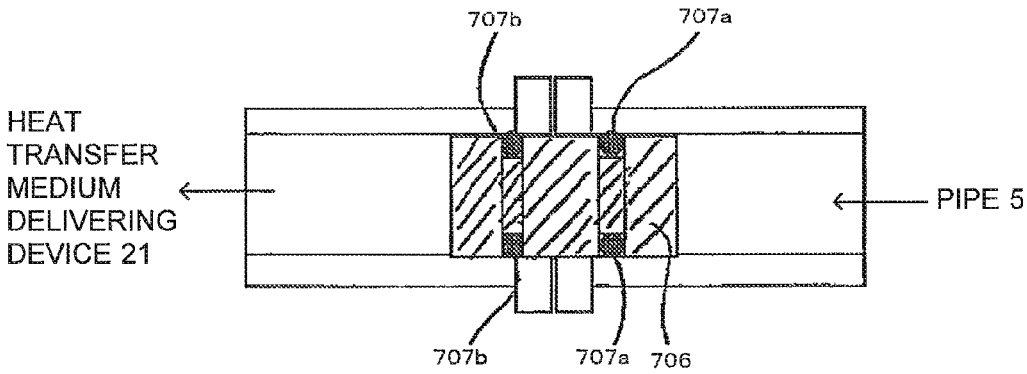
FIG. 11 is an enlarged schematic view illustrating a connecting portion of pipes.

FIG. 11 is an enlarged schematic view illustrating a connecting portion of the pipes 5. Referring to FIG. 11, a typical method of connecting pipes will be described. As illustrated in FIG. 11, pipes (including pipes attached to each heat medium delivering device (for example, a suction pipe 708 and a discharge pipe 709 illustrated in FIG. 12)) are connected to each other with an adapter 706. The adapter 706 is provided with two O-rings (an O-ring 707*a* and an O-ring 707*b*). The two O-rings are provided near the openings of the respective pipes.

Therefore, the connecting portion of the pipes is sealed with the O-ring 707*a* and the O-ring 707*b* provided to the adapter 706 fitted in the pipes. Thus, with the configuration including the adapter 706 provided with the O-ring 707*a* and the O-ring 707*b*, neither soldering nor brazing are necessary in detaching the heat medium delivering device 21. Consequently, the pipes and the heat medium delivering device can be easily detached.

Figure 12:
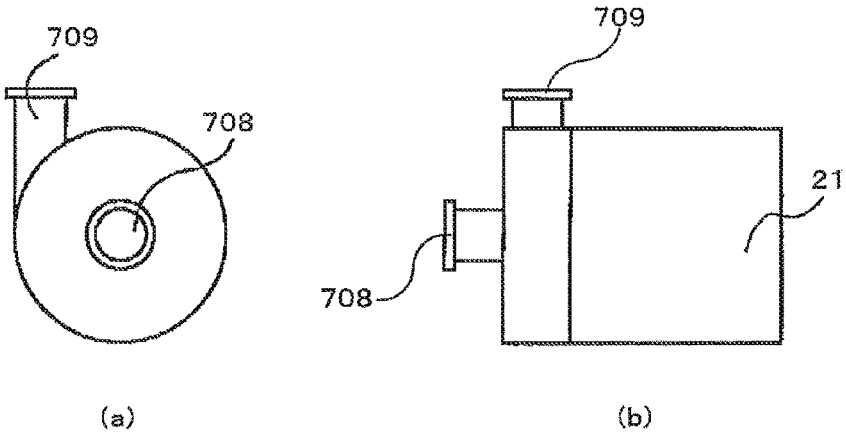
FIG. 12 are schematic diagrams each illustrating an appearance of a heat medium delivering device.

FIG. 12 are schematic diagrams each illustrating the appearance of the heat medium delivering device 21. Referring to FIG. 12, attaching and detaching of the heat medium delivering device 21 having a typical configuration will be described. FIG. 12(*a*) is a schematic diagram of the heat medium delivering device 21 seen from the top side (a side having the suction pipe 708). FIG. 12(*b*) is a schematic diagram of the heat medium delivering device 21 seen from a lateral side (a side substantially orthogonal to a portion having the suction pipe 708 and the discharge pipe 709).

The heat medium delivering device 21 is provided with the suction pipe 708, which is a suction port from which the heat medium is sucked, and with the discharge pipe 709, which is a discharge port from which the heat medium is discharged. As can be seen from FIG. 12, in the typical heat medium delivering device 21 that is commercially available, the suction port and the discharge port are not oriented in the same direction, i.e., in different directions that are orthogonal to each other.

In the case of the heat medium delivering device 21 having such a configuration (in which the orientations of the discharge port and the suction port are orthogonal to each other), even if the connection is made with the adapters 706 each provided with the O-ring 707*a* and the O-ring 707*b*, the heat medium delivering device 21 cannot be detached easily because the adapters 706 are fitted in the respective pipes (the suction pipe 708 and the discharge pipe 709 of the heat medium delivering device 21). Moreover, since the heat medium relay unit 3 is often provided above a ceiling or the like, there tends to be substantially no servicing space thereabove.

Figure 13:
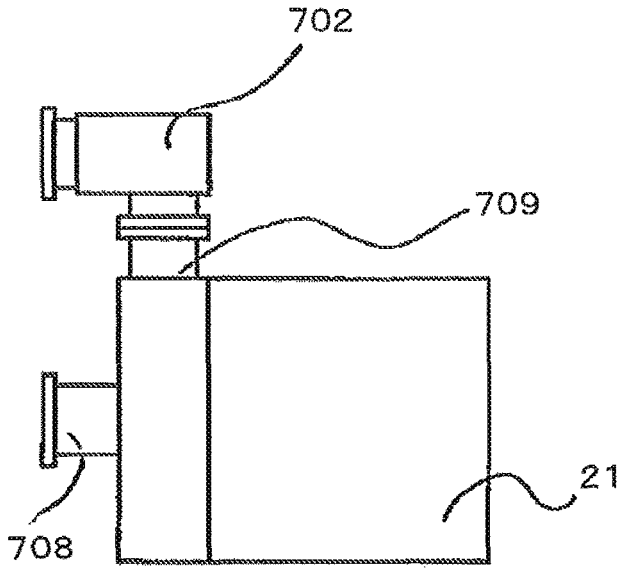
FIG. 13 is a schematic diagram illustrating an appearance of a heat medium delivering device with an adapter attached thereto.

FIG. 13 is a schematic diagram illustrating the appearance of the heat medium delivering device 21 with the adapter 702 attached thereto. Referring to FIG. 13, the adapter 702 attached to the heat medium delivering device 21 will be described. As described above referring to FIG. 12, if there is substantially no servicing space above the heat medium relay unit 3 installed, replacement parts (for example, the heat medium delivering devices 21 and the pipes 5) need to be configured so as to be attachable to and detachable from the heat medium relay unit 3 in the lateral direction.

Accordingly, each of the heat medium delivering devices 21 equipped in the heat medium relay unit 3 according to Embodiment is provided with the adapter 702 having a substantially L shape, thereby being attachable to and detachable from the heat medium relay unit 3 in the lateral direction. That is, the adapter 702 forms a substantially L-shaped flow path of the heat medium. By attaching the adapter 702 to the heat medium delivering device 21, the heat medium delivering device 21 becomes attachable to and detachable from the heat medium relay unit 3 in one direction. In Embodiment, all of the heat medium delivering devices 21 are collectively provided on the servicing side as illustrated in FIG. 8, and the adapter 702 is attached to each of the heat medium delivering devices 21. Thus, the attaching and detaching of the heat medium delivering devices 21 is facilitated, and serviceability is improved.

By configuring the heat medium delivering devices 21 so as to be easily attachable and detachable as in the heat medium relay unit 3 according to Embodiment, additional heat medium delivering devices 21 can be easily provided later. Additional heat medium delivering devices 21 can be provided in the space 710 of the metal fixing plate 700. That is, even after the installation of the heat medium relay unit 3, heat medium delivering devices 21 can be added easily, whereby the capacity of the heat medium circulation circuit B is increased easily.

Figure 14:
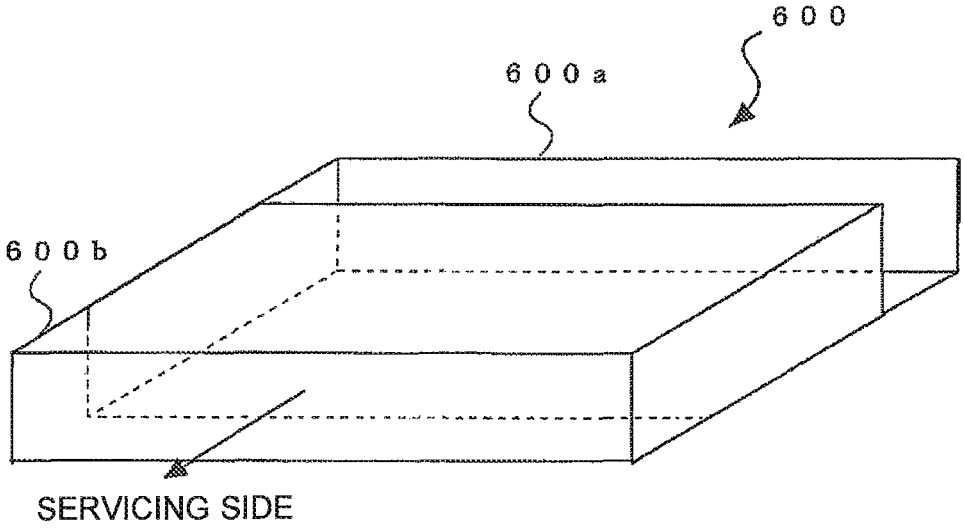
FIG. 14 is a diagram illustrating an exemplary housing that houses a heat medium relay unit.

FIG. 14 is a diagram illustrating an exemplary housing (hereinafter denoted as housing 600) that houses the heat medium relay unit 3. Referring to FIG. 14, the housing 600 of the heat medium relay unit 3 will be described. The heat medium relay unit 3 is housed in the housing 600. The housing 600 is a combination of a first housing 600*a* and a second housing 600*b*. The heat medium relay unit 3 is fixed to the first housing 600*a* and is not detachable. On the other hand, the second housing 600*b* is usually screwed to the first housing 600*a* but is displaceable (slidable), when unscrewed, in a direction indicated by the arrow illustrated in FIG. 14 (a direction toward the servicing side, i.e., a substantially horizontal direction).

Therefore, when the second housing 600*b* is slid to open or close in the direction in the servicing side, the heat medium relay unit 3 in the housing 600 is exposed on the servicing side. By configuring the housing 600 so as to be openable and closable by sliding the second housing 600*b*, even if the heat medium relay unit 3 is provided in a tight space, such as above a ceiling that has restrictions in the height direction, the second housing 600*b* can be detached easily by sliding the second housing 600*b* in a direction other than the height direction.

Accordingly, in the heat medium relay unit 3 according to Embodiment, the valve body rotating means of the first heat medium flow switching devices 22, the second heat medium flow switching devices 23, and the heat medium flow control devices 24, described above referring to FIG. 8, are collectively provided so as to be all oriented in one direction (toward the servicing side) to be replaceable from the side face (the service surface) of the first housing 600*a* of the heat medium relay unit 3. Furthermore, in the heat medium relay unit 3 according to Embodiment, the valve body rotating means of the first heat medium flow switching devices 22, the second heat medium flow switching devices 23, and the heat medium flow control devices 24 and the control device (not illustrated) controlling the heat medium delivering devices 21 are collectively provided so as to be all oriented in the direction of sliding of the second housing 600*b* (the direction toward the servicing side, i.e., a substantially horizontal direction) as illustrated in FIG. 8.

In this case, the valve body rotating means of the first heat medium flow switching devices 22, the second heat medium flow switching devices 23, and the heat medium flow control devices 24 are attached to side faces of the valve blocks 350, as illustrated in FIG. 7, with screws or the like. For example, if any valve body rotating means or any other members of the first heat medium flow switching devices 22, the second heat medium flow switching devices 23, and the heat medium flow control devices 24 fail and need to be repaired or parts be replaced, a worker or the like can stick his/her head and hands into the space above the ceiling and remove the screws. Thus, the valve body rotating means can be detached from the heat medium relay unit 3.

Furthermore, any attachment of means and devices relating to repair and parts replacement to the heat medium relay unit 3 can be done in the same manner. Thus, by collectively providing means, such as actuators that particularly tend to require maintenance, on one of the sides (in Embodiment, on one side (the servicing side)) of the heat medium relay unit 3, parts replacement and the like is facilitated and the ease of maintenance (maintainability) is significantly improved.

In this case, the housing 600 is openable and closable by sliding the second housing 600*b* in the lateral direction. Therefore, the housing 600 is openable and closable without troubles due to, for example, the lack of space in the height direction. Thus, a merit of thinness is enjoyed. Furthermore, the valve block unit 300 itself is constituted by the valve blocks 350 that are connected together. Therefore, when, for example, any instruments are added or removed, the valve blocks 350 can be added or removed easily. Furthermore, the main pipes and the like of the valve blocks 350 are integrated and the valve body rotating means are, for example, screwable. Therefore, for example, if the heat medium relay unit 3 is to be disposed of, the heat medium relay unit 3 can be disassembled easily.

Although the above description illustrates an exemplary case in which a first heat medium flow switching device 22, a second heat medium flow switching device 23, and a heat medium flow control device 24 are provided for each of the use side heat exchangers 26, the invention is not limited thereto. For example, one use side heat exchanger 26 may be connected to every foregoing device. In such a case, the first heat medium flow switching devices 22, the second heat medium flow switching devices 23, and the heat medium flow control devices 24 connected to one use side heat exchanger 26 only need to be operated each in the same manner. Furthermore, the above description concerns an exemplary case in which two heat exchangers related to heat medium 15 are provided, the number is not limited thereto, naturally. As long as the heat medium can be cooled and/or heated, three or more heat exchangers related to heat medium 15 may be provided as illustrated in FIG. 8.

Although the above description illustrates a case where the third temperature sensors 33 and the fourth temperature sensors 34 are provided in the heat medium relay unit 3, some or all of them may be provided in the indoor units 2. If they are provided in the heat medium relay unit 3, the valves, pumps, and so forth on the heat medium side can be collectively provided in one housing and it is therefore advantageous in terms of ease of maintenance. In contrast, if they are provided in the indoor units 2, they can be treated in the same manner as with expansion valves provided in conventional direct-expansion indoor units and can be therefore easily handled. Moreover, since they are provided near the use side heat exchangers 26, it is advantageous in that they are not affected by heat losses occurring in the extension pipes and that heating loads in the indoor units 2 are controlled well.

Figure 15:
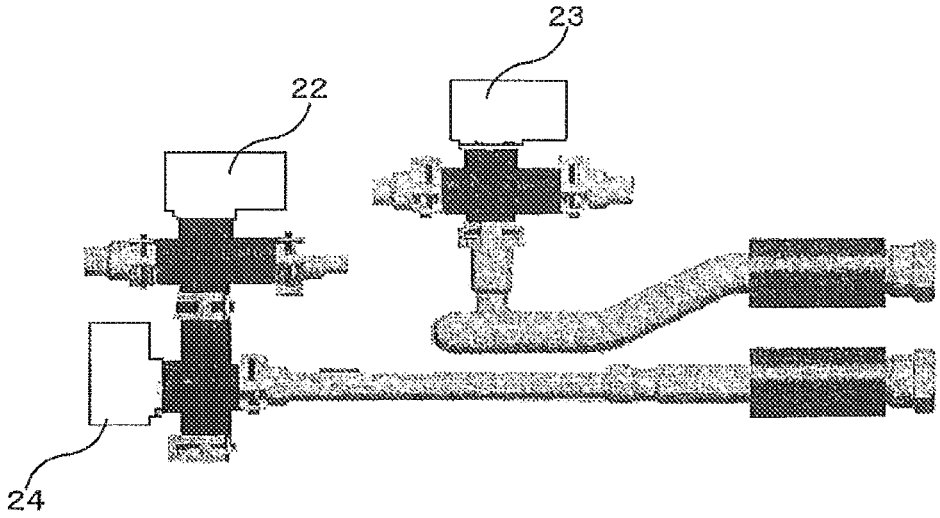
FIG. 15 is a schematic diagram illustrating an exemplary arrangement of valves equipped in the heat medium relay unit.

FIG. 15 is a schematic diagram illustrating an exemplary arrangement of the valves (the first heat medium flow switching device 22, the second heat medium flow switching device 23, and the heat medium flow control device 24) provided in the heat medium relay unit 3. Referring to FIG. 15, the exemplary arrangement of the valves provided in the heat medium relay unit 3 will be described. Although FIG. 7 illustrates an exemplary case in which the valves are in the form of a block, in FIG. 15, an exemplary case in which the valves provided in the heat medium relay unit 3 are not in the form of a block is illustrated.

In FIG. 15, the second heat medium flow switching device 23 and a pair of the first heat medium flow switching device 22 and the heat medium flow control device 24 are provided in respective pipes 5, in accordance with the circuit diagram illustrated in FIG. 4. In the heat medium relay unit 3, as illustrated in FIG. 15, the second heat medium flow switching device 23 and the pair of the first heat medium flow switching device 22 and the heat medium flow control device 24 may be provided separately from each other. Providing the valves provided in the heat medium relay unit 3 in the form of a block as illustrated in FIG. 7 contributes to size reduction of the heat medium relay unit 3. Considering versatility, however, the valves may be provided separately.

Figure 16:
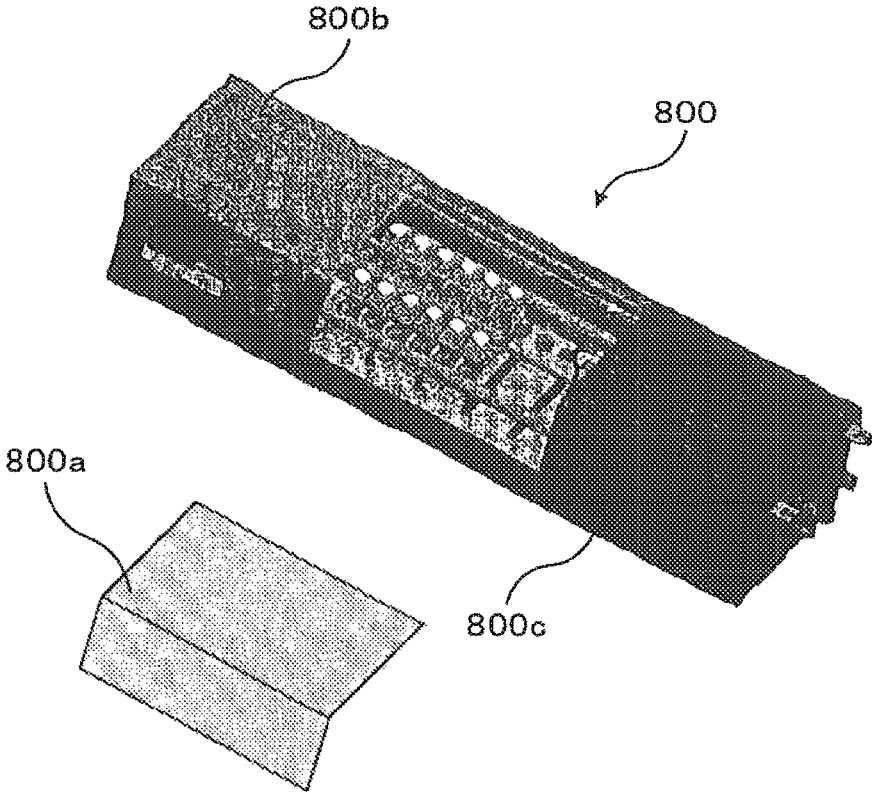
FIG. 16 is a diagram illustrating an exemplary housing that houses the heat medium relay unit including the valves illustrated in FIG. 15.

FIG. 16 is a diagram illustrating another exemplary housing (hereinafter denoted as housing 800) that houses the heat medium relay unit 3 equipped with the valves illustrated in FIG. 15. Referring to FIG. 16, the housing 800 of the heat medium relay unit 3 will be described. The heat medium relay unit 3 is housed in the housing 800. The housing 800 is a combination of an upper housing 800*b* and a lower housing 800*c*. The upper housing 800*b* is provided with a removable lid body 800*a* constituting a portion of the upper housing 800*b*.

The heat medium relay unit 3 is fixed to the upper housing 800*b* and the lower housing 800*c* and is not detachable therefrom. On the other hand, the lid body 800*a* is usually secured to the upper housing 800*b* with screws or the like and is removable, when the screws or the like are removed, and by moving (sliding) the lid body in a direction indicated by the arrow illustrated in FIG. 16 (the direction toward the servicing side, i.e., a direction substantially orthogonal to the direction in which the heat medium flows into and out of the heat medium relay unit 3 (for example, the horizontal direction)).

Therefore, when the lid body 800*a* is removed in the direction toward the servicing side, the heat medium relay unit 3 in the housing 800 is exposed at a portion ranging from the servicing side to an upper portion. By configuring the housing 800 such that the lid body 800*a* is removable, even if the heat medium relay unit 3 is provided in a tight space, such as above a ceiling that has restrictions in the height direction, the lid body 800*a* can be removed easily by removing the lid body 800*a* in the direction toward the servicing side.

Accordingly, in the heat medium relay unit 3 according to Embodiment, the first heat medium flow switching devices 22, the second heat medium flow switching devices 23, and the heat medium flow control devices 24 illustrated in FIG. 8 are collectively provided so as to be all oriented in one direction (toward the servicing side) to be replaceable from a side of the housing 800 of the heat medium relay unit 3. Thus, by collectively providing means, such as actuators that particularly tend to require maintenance, on one of the sides of the heat medium relay unit 3 (in Embodiment, on one side (the servicing side)), parts replacement and the like is facilitated and the ease of maintenance (maintainability) is significantly improved.

In this case, the housing 800 is openable and closable by removing the lid body 800*a* in the lateral direction. Therefore, the housing 800 is openable and closable without troubles due to, for example, tightness of the space in the height direction. Thus, a merit of thinness is enjoyed.

Figure 17:
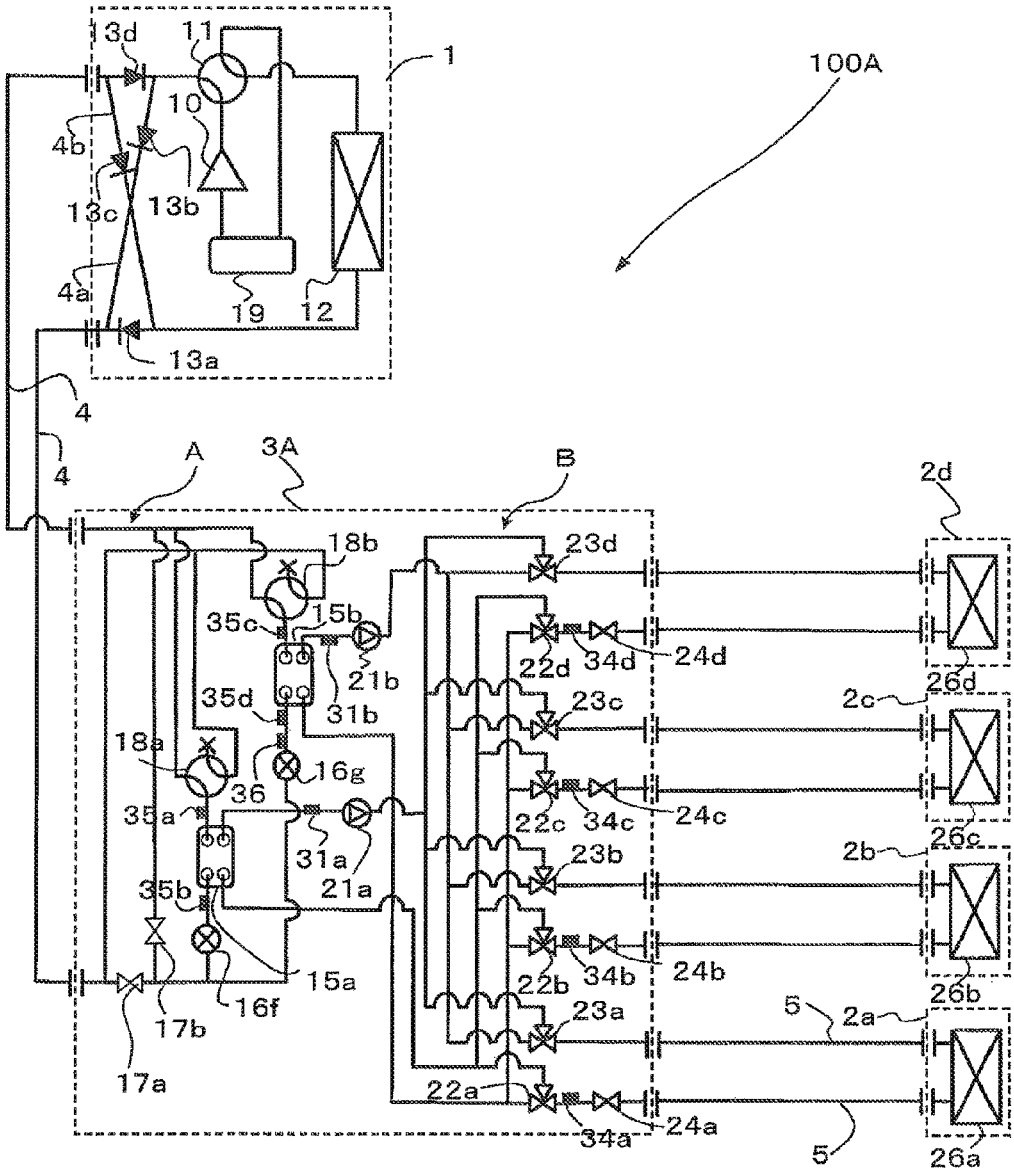
FIG. 17 is a schematic circuit configuration diagram illustrating an exemplary circuit configuration of an air-conditioning apparatus according to Embodiment of the invention.

FIG. 17 is a schematic circuit configuration diagram illustrating an exemplary circuit configuration of another air-conditioning apparatus (hereinafter denoted as air-conditioning apparatus 100A) according to Embodiment of the invention. Referring to FIG. 17, details of the circuit configuration of the air-conditioning apparatus 100A including a heat medium relay unit (hereinafter denoted as heat medium relay unit 3A) having a different configuration from the above-described heat medium relay unit 3 will be described. The configuration of the heat medium relay unit 3A included in the air-conditioning apparatus 100A illustrated in FIG. 17 is different from the configuration of the heat medium relay unit 3 included in the above-described air-conditioning apparatus 100.

As illustrated in FIG. 17, in the air-conditioning apparatus 100A, an outdoor unit 1 and the heat medium relay unit 3A are connected to each other with refrigerant pipes 4 at a first heat exchanger related to heat medium 15*a* and a second heat exchanger related to heat medium 15*b* that are provided in the heat medium relay unit 3A. Furthermore, in the air-conditioning apparatus 100A, the heat medium relay unit 3A and indoor units 2 are connected to each other with pipes 5 at the first heat exchanger related to heat medium 15*a* and the second heat exchanger related to heat medium 15*b*. Now, differences from the above-described air-conditioning apparatus 100 will be mainly described.

[Heat-Transfer-Medium Relay Unit 3A]

The heat medium relay unit 3A is equipped with two heat exchangers related to heat medium 15, two expansion devices 16, two opening/closing devices 17, two refrigerant flow switching devices 18, two heat medium delivering devices 21, four first heat medium flow switching devices 22, four second heat medium flow switching devices 23, and four heat medium flow control devices 24. The heat exchangers related to heat medium 15, the heat medium delivering devices 21, the first heat medium flow switching devices 22, the second heat medium flow switching devices 23, and the heat medium flow control devices 24 are the same as those described above, and description thereof is omitted. Detecting means are also the same as those described above, and detection thereof is omitted.

The two expansion devices 16 (an expansion device 16*f* and an expansion device 16*g*) function as pressure reducing valves or expansion valves and each expand the heat source side refrigerant by reducing the pressure of the heat source side refrigerant. The expansion device 16*f* is provided on the upstream side of the first heat exchanger related to heat medium 15*a* in the flow of the heat source side refrigerant when in the cooling operation. The expansion device 16*g* is provided on the upstream side of the second heat exchanger related to heat medium 15*b* in the flow of the heat source side refrigerant when in the cooling operation. The two expansion devices 16 may be devices, such as an electronic expansion valve, whose opening degree is variably controllable.

The two opening/closing devices 17 (an opening/closing device 17*a* and an opening/closing device 17*b*) are two-way valves or the like and open and close the refrigerant pipes 4. The opening/closing device 17*a* is provided in the refrigerant pipe 4 on the inflowing side of the heat source side refrigerant. The opening/closing device 17*b* is provided in a pipe connecting the refrigerant pipes 4 on the inflowing side and outflowing side of the heat source side refrigerant.

The two refrigerant flow switching devices 18 (a refrigerant flow switching device 18*a* and a refrigerant flow switching device 18*b*) are four-way valves or the like and switch the flow of the heat source side refrigerant in accordance with the operation mode. The refrigerant flow switching device 18*a* is provided on the downstream side of the first heat exchanger related to heat medium 15*a* in the flow of the heat source side refrigerant when in the cooling operation. The refrigerant flow switching device 18*b* is provided on the downstream side of the second heat exchanger related to heat medium 15*b* in the flow of the heat source side refrigerant when in the cooling only operation.

Operation modes that the air-conditioning apparatus 100A undergoes will now be described. The air-conditioning apparatus 100A can undergo a cooling operation or a heating operation in each of the indoor units 2 in accordance with instructions from the indoor units 2. That is, the air-conditioning apparatus 100A allows all of the indoor units 2 to perform the same operation and also allows the indoor units 2 to individually perform different operations. The operation modes that the air-conditioning apparatus 100A undergoes include a cooling only operation mode in which all of the indoor units 2 that are being driven perform cooling operations, a heating only operation mode in which all of the indoor units 2 that are being driven perform heating operations, a cooling main operation mode in which the cooling load is the larger, and a heating main operation mode in which the heating load is the larger. These operation modes will now be described together with the flows of the heat source side refrigerant and the heat medium.

[Cooling Only Operation Mode]

Figure 18:
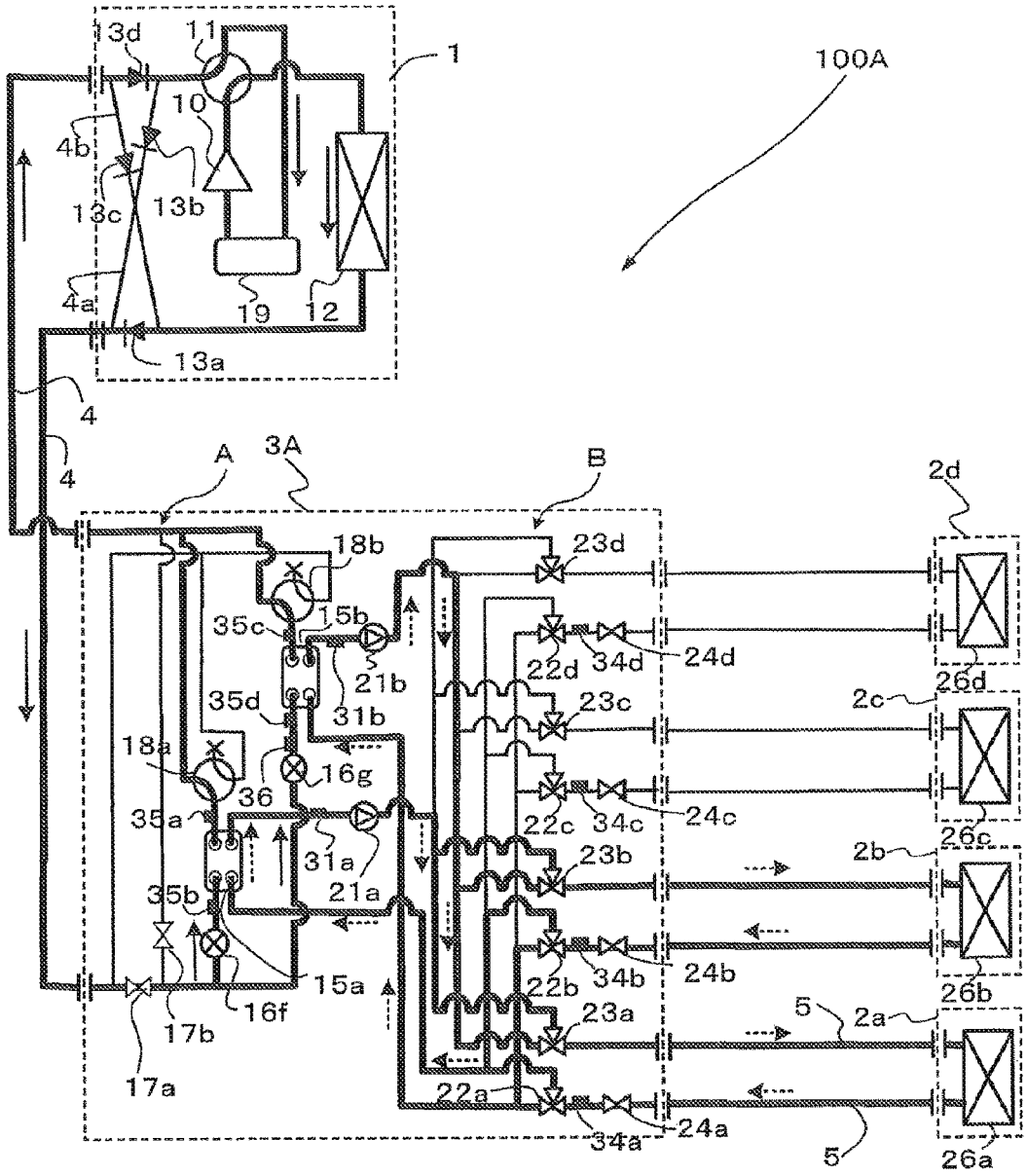
FIG. 18 is a refrigerant circuit diagram illustrating the flow of a refrigerant when an air-conditioning apparatus according to Embodiment of the invention is in a cooling only operation mode.

FIG. 18 is a refrigerant circuit diagram illustrating the flow of the refrigerant when the air-conditioning apparatus 100A is in the cooling only operation mode. Referring to FIG. 18, the cooling only operation mode will be described with an exemplary case with cooling loads only in the use side heat exchanger 26*a* and the use side heat exchanger 26*b*. In FIG. 18, pipes represented by the bold lines are pipes through which the refrigerants (the heat source side refrigerant and the heat medium) flow. Furthermore, in FIG. 18, the direction of flow of the heat source side refrigerant is indicated by the solid-line arrows, and the direction of flow of the heat medium is indicated by the broken-line arrows.

In the cooling only operation mode illustrated in FIG. 18, the four-way valve 11 in the outdoor unit 1 switches such that the heat source side refrigerant that has been discharged from the compressor 10 flows into the heat source side heat exchanger 12. In the heat medium relay unit 3A, the first heat medium delivering device 21*a* and the second heat medium delivering device 21*b* are driven, the heat medium flow control device 24*a* and the heat medium flow control device 24*b* are opened, and the heat medium flow control device 24*c* and the heat medium flow control device 24*d* are closed. Thus, the heat medium is allowed to circulate between each of the first heat exchanger related to heat medium 15*a* and the second heat exchanger related to heat medium 15*b* and each of the use side heat exchanger 26*a* and the use side heat exchanger 26*b*.

First, the flow of the heat source side refrigerant in the refrigerant circulation circuit A will be described.

Low temperature and low pressure refrigerant is compressed by the compressor 10 and is discharged as high temperature and high pressure gas refrigerant. The high temperature and high pressure gas refrigerant that has been discharged from the compressor 10 flows through the four-way valve 11 into the heat source side heat exchanger 12. In the heat source side heat exchanger 12, the gas refrigerant is condensed and liquefied while transferring its heat to the outdoor air, thereby turning into high pressure liquid refrigerant. The high pressure liquid refrigerant that has flowed out of the heat source side heat exchanger 12 flows through the check valve 13*a* and out of the outdoor unit 1 and flows through the refrigerant pipe 4 into the heat medium relay unit 3A. The high pressure liquid refrigerant that has flowed into the heat medium relay unit 3A flows through the opening/closing device 17*a* into different branches. The liquid refrigerant is then expanded by the expansion device 16*f* and the expansion device 16*g*, thereby turning into a low temperature and low pressure, two-phase refrigerant.

The two-phase refrigerant flows into the first heat exchanger related to heat medium 15*a* and the second heat exchanger related to heat medium 15*b* functioning as evaporators and cools the heat medium by receiving heat from the heat medium circulating through the heat medium circulation circuit B, thereby turning into a low temperature and low pressure gas refrigerant. The gas refrigerant that has flowed out of the first heat exchanger related to heat medium 15*a* and the second heat exchanger related to heat medium 15*b* flows through the refrigerant flow switching device 18*a* and the refrigerant flow switching device 18*b* and out of the heat medium relay unit 3A, and flows through the refrigerant pipe 4 into the outdoor unit 1 again. The refrigerant that has flowed into the outdoor unit 1 flows through the check valve 13*d*, the four-way valve 11, and the accumulator 19, and is sucked into the compressor 10 again.

In this case, the opening degree of the expansion device 16*f* is controlled such that the superheat (the degree of superheat) obtained as the difference between the temperatures detected at the inlet and the outlet of the first heat exchanger related to heat medium 15*a* is constant. Likewise, the opening degree of the expansion device 16*g* is controlled such that the superheat obtained as the difference between the temperature detected by a first refrigerant temperature sensor 35*c* and the temperature detected by a first refrigerant temperature sensor 35*d* is constant. Furthermore, the opening/closing device 17*a* is opened, and the opening/closing device 17*b* is closed.

Now, the flow of the heat medium in the heat medium circulation circuit B will be described.

In the cooling only operation mode, cooling energy of the heat source side refrigerant is transferred to the heat medium in both the first heat exchanger related to heat medium 15*a* and the second heat exchanger related to heat medium 15*b*, and the heat medium thus cooled is made to flow through the pipes 5 by the first heat medium delivering device 21*a* and the second heat medium delivering device 21*b*. The heat medium that has been pressurized by and has flowed out of the first heat medium delivering device 21*a* and the second heat medium delivering device 21*b* flows through the second heat medium flow switching device 23*a* and the second heat medium flow switching device 23*b* into the use side heat exchanger 26*a* and the use side heat exchanger 26*b*. Then, in the use side heat exchanger 26*a* and the use side heat exchanger 26*b*, the heat medium receives heat from the indoor air, thereby cooling the indoor spaces 7.

Subsequently, the heat medium flows out of the use side heat exchanger 26*a* and the use side heat exchanger 26*b* into the heat medium flow control device 24*a* and the heat medium flow control device 24*b*. In this case, the heat medium flow control device 24*a* and the heat medium flow control device 24*b* function such that the flow rates of the heat medium flowing into the use side heat exchanger 26*a* and the use side heat exchanger 26*b* be values required to cover the air conditioning loads demanded in the rooms, respectively. The heat medium that has flowed out of the heat medium flow control device 24*a* and the heat medium flow control device 24*b* flows through the first heat medium flow switching device 22*a* and the first heat medium flow switching device 22*b* into the heat exchanger related to heat medium 15*a* and the heat exchanger related to heat medium 15*b* and is sucked into the first heat medium delivering device 21*a* and the second heat medium delivering device 21*b* again.

In the pipes 5 of the use side heat exchangers 26, the heat medium flows in a direction from the second heat medium flow switching devices 23 toward the first heat medium flow switching devices 22 through the heat medium flow control devices 24. The air conditioning loads demanded in the indoor spaces 7 can be covered by controlling the difference between the temperature detected by the first temperature sensor 31*a* or the temperature detected by the first temperature sensor 31*b* and the temperature detected by the second temperature sensor 32 to be maintained at a target value. The temperature detected by either the first temperature sensor 31*a* or the first temperature sensor 31*b*, or the average of these temperatures may be used as the temperature at the outlet of the heat exchanger related to heat medium 15. In this case, the first heat medium flow switching devices 22 and the second heat medium flow switching devices 23 are each set to an intermediate opening degree so that flow paths to the heat exchanger related to heat medium 15*a* and to the heat exchanger related to heat medium 15*b* are both provided.

In the cooling only operation mode, there is no need to make the heat medium flow into use side heat exchangers 26 in which there is no heating load (including those in the thermo-off state). Therefore, relevant flow paths are closed by the relevant heat medium flow control devices 24, so that the heat medium does not flow into such use side heat exchangers 26. In FIG. 18, the heat medium is made to flow into the use side heat exchanger 26*a* and the use side heat exchanger 26*b* with heating loads. On the other hand, there is no heating load in the use side heat exchanger 26*c* and the use side heat exchanger 26*d*, and the corresponding heat medium flow control device 24*c* and heat medium flow control device 24*d* are therefore fully closed. If there is any heating load in the use side heat exchanger 26*c* and/or the use side heat exchanger 26*d*, the heat medium flow control device 24*c* and/or the heat medium flow control device 24*d* only need to be opened so as to allow the heat medium to circulate.

[Heating Only Operation Mode]

Figure 19:
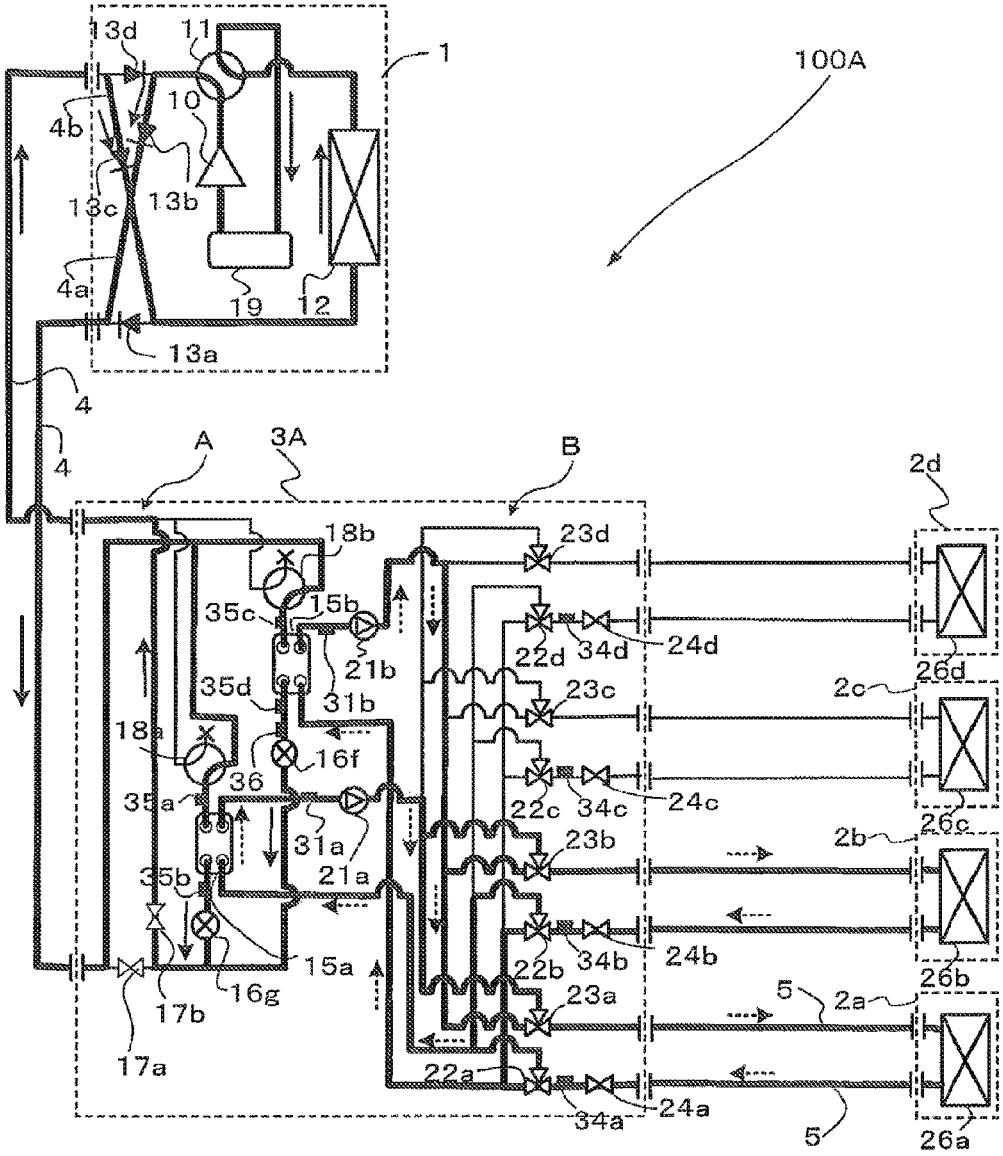
FIG. 19 is a refrigerant circuit diagram illustrating the flow of a refrigerant when an air-conditioning apparatus according to Embodiment of the invention is in a heating only operation mode.

FIG. 19 is a refrigerant circuit diagram illustrating the flow of the refrigerant when the air-conditioning apparatus 100A is in the heating only operation mode. Referring to FIG. 19, the heating only operation mode will be described with an exemplary case with heating loads only in the use side heat exchanger 26*a* and the use side heat exchanger 26*b*. In FIG. 19, pipes represented by the bold lines are pipes through which the refrigerants (the heat source side refrigerant and the heat medium) flow. Furthermore, in FIG. 19, the direction of flow of the heat source side refrigerant is indicated by the solid-line arrows, and the direction of flow of the heat medium is indicated by the broken-line arrows.

In the heating only operation mode illustrated in FIG. 19, the four-way valve 11 in the outdoor unit 1 switches such that the heat source side refrigerant that has been discharged from the compressor 10 flows into the heat medium relay unit 3A without flowing through the heat source side heat exchanger 12. In the heat medium relay unit 3A, the first heat medium delivering device 21*a* and the second heat medium delivering device 21*b* are driven, the heat medium flow control device 24*a* and the heat medium flow control device 24*b* are open, and the heat medium flow control device 24*c* and the heat medium flow control device 24*d* are closed. Thus, the heat medium is allowed to circulate between each of the first heat exchanger related to heat medium 15*a* and the second heat exchanger related to heat medium 15*b* and each of the use side heat exchanger 26*a* and the use side heat exchanger 26*b*.

First, the flow of the heat source side refrigerant in the refrigerant circulation circuit A will be described.

Low temperature and low pressure refrigerant is compressed by the compressor 10 and is discharged as high temperature and high pressure gas refrigerant. The high temperature and high pressure gas refrigerant that has been discharged from the compressor 10 flows through the four-way valve 11, is directed through the first connection pipe 4*a*, and flows through the check valve 13*b* and out of the outdoor unit 1. The high temperature and high pressure gas refrigerant that has flowed out of the outdoor unit 1 flows through the refrigerant pipe 4 into the heat medium relay unit 3A. The high temperature and high pressure gas refrigerant that has flowed into the heat medium relay unit 3A is branched and flows through the refrigerant flow switching device 18*a* and the refrigerant flow switching device 18*b* into the first heat exchanger related to heat medium 15*a* and the second heat exchanger related to heat medium 15*b*.

The high temperature and high pressure gas refrigerant that has flowed into the first heat exchanger related to heat medium 15*a* and the second heat exchanger related to heat medium 15*b* is condensed and liquefied while transferring its heat to the heat medium circulating through the heat medium circulation circuit B, thereby turning into high pressure liquid refrigerant. The liquid refrigerant that has flowed out of the first heat exchanger related to heat medium 15*a* and the second heat exchanger related to heat medium 15*b* is expanded by the expansion device 16*f* and the expansion device 16*g*, thereby turning into a low temperature and low pressure, two-phase refrigerant. The two-phase refrigerant flows through the opening/closing device 17*b* and out of the heat medium relay unit 3A and flows through the refrigerant pipe 4 into the outdoor unit 1 again. The refrigerant that has flowed into the outdoor unit 1 is directed through the second connection pipe 4*b* and flows through the check valve 13*c* into the heat source side heat exchanger 12 functioning as an evaporator.

Subsequently, the refrigerant that has flowed into the heat source side heat exchanger 12 receives heat from the outdoor air in the heat source side heat exchanger 12, thereby turning into a low temperature and low pressure gas refrigerant. The low temperature and low pressure gas refrigerant that has flowed out of the heat source side heat exchanger 12 flows through the four-way valve 11 and the accumulator 19 and is sucked into the compressor 10 again.

In this case, the opening degree of the expansion device 16*f* is controlled such that the subcool (the degree of subcooling) obtained as the difference between the saturation temperature that is a conversion of the pressure detected by the pressure sensor 36 and the temperature detected by a first refrigerant temperature sensor 35*b* is constant. Likewise, the opening degree of the expansion device 16*g* is controlled such that the subcool obtained as the difference between the saturation temperature that is a conversion of the pressure detected by the pressure sensor 36 and the temperature detected by the first refrigerant temperature sensor 35*d* is constant. Furthermore, the opening/closing device 17*a* is closed, and the opening/closing device 17*b* is open. If the temperature at an intermediate position between the heat exchangers related to heat medium 15 is measureable, the temperature measured at the intermediate position may be used instead of the value of the pressure sensor 36. Thus, the apparatus can be configured at low cost.

Now, the flow of the heat medium in the heat medium circulation circuit B will be described.

In the heating only operation mode, heating energy of the heat source side refrigerant is transferred to the heat medium in both the first heat exchanger related to heat medium 15*a* and the second heat exchanger related to heat medium 15*b*. The heat medium thus heated is made to flow through the pipes 5 by the first heat medium delivering device 21*a* and the second heat medium delivering device 21*b*. The heat medium that has been pressurized by and has flowed out of the first heat medium delivering device 21*a* and the second heat medium delivering device 21*b* flows through the second heat medium flow switching device 23*a* and the second heat medium flow switching device 23*b* into the use side heat exchanger 26*a* and the use side heat exchanger 26*b*. Then, in the use side heat exchanger 26*a* and the use side heat exchanger 26*b*, the heat medium transfers its heat to the indoor air, thereby heating the indoor spaces 7.

Subsequently, the heat medium flows out of the use side heat exchanger 26*a* and the use side heat exchanger 26*b* into the heat medium flow control device 24*a* and the heat medium flow control device 24*b*. In this case, the heat medium flow control device 24*a* and the heat medium flow control device 24*b* function such that the flow rates of the heat medium flowing into the use side heat exchanger 26*a* and the use side heat exchanger 26*b* be values required to cover the air conditioning loads demanded in the rooms, respectively. The heat medium that has flowed out of the heat medium flow control device 24*a* and the heat medium flow control device 24*b* flows through the first heat medium flow switching device 22*a* and the first heat medium flow switching device 22*b* into the first heat exchanger related to heat medium 15*a* and the second heat exchanger related to heat medium 15*b* and is sucked into the first heat medium delivering device 21*a* and the second heat medium delivering device 21*b* again.

In the pipes 5 of the use side heat exchangers 26, the heat medium flows in a direction from the second heat medium flow switching devices 23 toward the first heat medium flow switching devices 22 through the heat medium flow control devices 24. The air conditioning loads demanded in the indoor spaces 7 can be covered by controlling the difference between the temperature detected by the first temperature sensor 31*a* or the temperature detected by the first temperature sensor 31*b* and the temperature detected by the second temperature sensor 32 to be maintained at a target value. The temperature detected by either the first temperature sensor 31*a* or the first temperature sensor 31*b*, or the average of these temperatures may be used as the temperature at the outlet of the heat exchanger related to heat medium 15.

In this case, the first heat medium flow switching devices 22 and the second heat medium flow switching devices 23 are each set to an intermediate opening degree so that flow paths to the first heat exchanger related to heat medium 15*a* and to the second heat exchanger related to heat medium 15*b* are both provided. Essentially, the use side heat exchangers 26 should be each controlled on the basis of the difference between the temperatures at the inlet and the outlet thereof. The temperature of the heat medium at the inlet of each use side heat exchanger 26 is almost the same as the temperature detected by the first temperature sensor 31*b*. Therefore, by using the first temperature sensor 31*b*, the number of temperature sensors can be reduced, and the apparatus can be configured at low cost.

In the heating only operation mode, there is no need to make the heat medium flow into use side heat exchangers 26 in which there is no heating load (including those in the thermo-off state). Therefore, relevant flow paths are closed by the relevant heat medium flow control devices 24, so that the heat medium does not flow into such use side heat exchangers 26. In FIG. 19, the heat medium is made to flow into the use side heat exchanger 26*a* and the use side heat exchanger 26*b* with heating loads. On the other hand, there is no heating load in the use side heat exchanger 26*c* and the use side heat exchanger 26*d*, and the corresponding heat medium flow control device 24*c* and heat medium flow control device 24*d* are therefore fully closed. If there is any heating load in the use side heat exchanger 26*c* and/or the use side heat exchanger 26*d*, the heat medium flow control device 24*c* and/or the heat medium flow control device 24*d* only need to be opened so as to allow the heat medium to circulate.

[Cooing Main Operation Mode]

Figure 20:
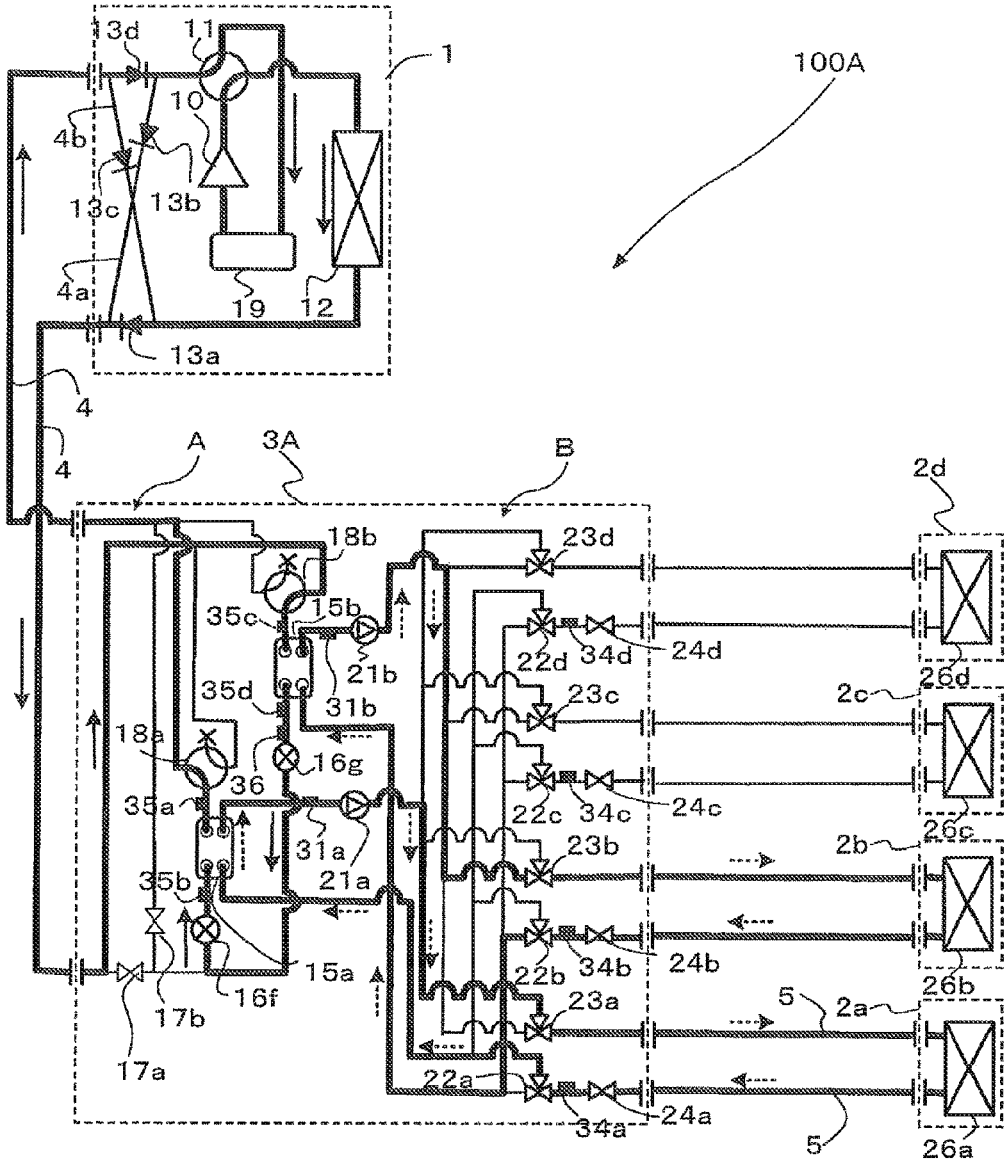
FIG. 20 is a refrigerant circuit diagram illustrating the flow of a refrigerant when an air-conditioning apparatus according to Embodiment of the invention is in a cooling main operation mode.

FIG. 20 is a refrigerant circuit diagram illustrating the flow of the refrigerant when the air-conditioning apparatus 100A is in the cooling main operation mode. Referring to FIG. 20, the cooling main operation mode will be described with an exemplary case in which there is a cooling load in the use side heat exchanger 26*a* and a heating load in the use side heat exchanger 26*b*. In FIG. 20, pipes represented by the bold lines are pipes through which the refrigerants (the heat source side refrigerant and the heat medium) flow. Furthermore, in FIG. 20, the direction of flow of the heat source side refrigerant is indicated by the solid-line arrows, and the direction of flow of the heat medium is indicated by the broken-line arrows.

In the cooling main operation mode illustrated in FIG. 20, the four-way valve 11 in the outdoor unit 1 switches such that the heat source side refrigerant that has been discharged from the compressor 10 flows into the heat source side heat exchanger 12. In the heat medium relay unit 3A, the first heat medium delivering device 21*a* and the second heat medium delivering device 21*b* are driven, the heat medium flow control device 24*a* and the heat medium flow control device 24*b* are open, and the heat medium flow control device 24*c* and the heat medium flow control device 24*d* are closed. Thus, the heat medium is allowed to circulate between the first heat exchanger related to heat medium 15*a* and the use side heat exchanger 26*a* and between the second heat exchanger related to heat medium 15*b* and the use side heat exchanger 26*b*.

First, the flow of the heat source side refrigerant in the refrigerant circulation circuit A will be described.

Low temperature and low pressure refrigerant is compressed by the compressor 10 and is discharged as high temperature and high pressure gas refrigerant. The high temperature and high pressure gas refrigerant that has been discharged from the compressor 10 flows through the four-way valve 11 into the heat source side heat exchanger 12. In the heat source side heat exchanger 12, the gas refrigerant is condensed by transferring its heat to the outdoor air, thereby turning into a two-phase refrigerant. The two-phase refrigerant that has flowed out of the heat source side heat exchanger 12 flows through the check valve 13*a* and out of the outdoor unit 1 and flows through the refrigerant pipe 4 into the heat medium relay unit 3A. The two-phase refrigerant that has flowed into the heat medium relay unit 3A flows through the second refrigerant flow switching device 18*b* into the second heat exchanger related to heat medium 15*b* functioning as a condenser.

The two-phase refrigerant that has flowed into the second heat exchanger related to heat medium 15*b* is condensed and liquefied while transferring its heat to the heat medium circulating through the heat medium circulation circuit B, thereby turning into a liquid refrigerant. The liquid refrigerant that has flowed out of the second heat exchanger related to heat medium 15*b* is expanded by the expansion device 16*g*, thereby turning into a low pressure, two-phase refrigerant. The low pressure, two-phase refrigerant flows through the expansion device 16*f* into the first heat exchanger related to heat medium 15*a* functioning as an evaporator. The low pressure, two-phase refrigerant that has flowed into the first heat exchanger related to heat medium 15*a* cools the heat medium by receiving heat from the heat medium circulating through the heat medium circulation circuit B, thereby turning into a gas refrigerant at a low pressure. The gas refrigerant flows out of the first heat exchanger related to heat medium 15*a*, flows through the second refrigerant flow switching device 18*a* and out of the heat medium relay unit 3A, and flows through the refrigerant pipe 4 into the outdoor unit 1 again. The refrigerant that has flowed into the outdoor unit 1 flows through the check valve 13*d*, the four-way valve 11, and the accumulator 19, and is sucked into the compressor 10 again.

In this case, the opening degree of the expansion device 16*g* is controlled such that the superheat obtained as the difference between the temperature detected by a first refrigerant temperature sensor 35*a* and the temperature detected by the first refrigerant temperature sensor 35*b* is constant. Furthermore, the expansion device 16*f* is fully open, the opening/closing device 17*a* is closed, and the opening/closing device 17*b* is closed. The opening degree of the expansion device 16*g* may alternatively be controlled such that the subcool obtained as the difference between the saturation temperature that is a conversion of the pressure detected by the pressure sensor 36 and the temperature detected by the first refrigerant temperature sensor 35*d* is constant. Moreover, the superheat or the subcool may be controlled by the expansion device 16*f* with the expansion device 16*g* fully open.

Now, the flow of the heat medium in the heat medium circulation circuit B will be described.

In the cooling main operation mode, heating energy of the heat source side refrigerant is transferred to the heat medium in the second heat exchanger related to heat medium 15*b*, and the heat medium thus heated is made to flow through corresponding ones of the pipes 5 by the second heat medium delivering device 21*b*. Furthermore, in the cooling main operation mode, cooling energy of the heat source side refrigerant is transferred to the heat medium in the first heat exchanger related to heat medium 15*a*, and the heat medium thus cooled is made to flow through corresponding ones of the pipes 5 by the first heat medium delivering device 21*a*. The heat medium that has been pressurized by and has flowed out of the first heat medium delivering device 21*a* and the second heat medium delivering device 21*b* flows through the second heat medium flow switching device 23*a* and the second heat medium flow switching device 23*b* into the use side heat exchanger 26*a* and the use side heat exchanger 26*b*, respectively.

In the use side heat exchanger 26*b*, the heat medium transfers its heat to the indoor air, whereby the indoor space 7 is heated. In the use side heat exchanger 26*a*, the heat medium receives heat from the indoor air, whereby the indoor space 7 is cooled. In this case, the heat medium flow control device 24*a* and the heat medium flow control device 24*b* function such that the flow rates of the heat medium flowing into the use side heat exchanger 26*a* and the use side heat exchanger 26*b* be values required to cover the air conditioning loads demanded in the rooms, respectively. The heat medium that has flowed through the use side heat exchanger 26*b* and whose temperature has slightly dropped flows through the heat medium flow control device 24*b* and the first heat medium flow switching device 22*b* into the second heat exchanger related to heat medium 15*b* and is sucked into the second heat medium delivering device 21*b* again. The heat medium that has flowed through the use side heat exchanger 26*a* and whose temperature has slightly risen flows through the heat medium flow control device 24*a* and the first heat medium flow switching device 22*a* into the first heat exchanger related to heat medium 15*a* and is sucked into the first heat medium delivering device 21*a* again.

During the above sequence, the first heat medium flow switching devices 22 and the second heat medium flow switching devices 23 function so as to prevent the hot heat medium and the cold heat medium from being mixed together. Therefore, the hot heat medium and the cold heat medium are directed to the respective use side heat exchangers 26 where there are heating load and cooling load. In the pipes 5 of the use side heat exchangers 26, on both the heating side and the cooling side, the heat medium flows in a direction from the second heat medium flow switching devices 23 toward the first heat medium flow switching devices 22 through the heat medium flow control devices 24. The air conditioning loads demanded in the indoor spaces 7 can be covered by controlling, on the heating side, the difference between the temperature detected by the first temperature sensor 31*b* and the temperature detected by the second temperature sensor 32 and, on the cooling side, the difference between the temperature detected by the second temperature sensor 32 and the temperature detected by the first temperature sensor 31*a* to be maintained at respective target values.

In the cooling main operation mode, there is no need to make the heat medium flow into use side heat exchangers 26 in which there is no heating load (including those in the thermo-off state). Therefore, relevant flow paths are closed by the relevant heat medium flow control devices 24, so that the heat medium does not flow into such use side heat exchangers 26. In FIG. 20, the heat medium is made to flow into the use side heat exchanger 26*a* and the use side heat exchanger 26*b* with heating loads. On the other hand, there is no heating load on the use side heat exchanger 26*c* and the use side heat exchanger 26*d*, and the corresponding heat medium flow control device 24*c* and heat medium flow control device 24*d* are therefore fully closed. If there is any heating load in the use side heat exchanger 26*c* and/or the use side heat exchanger 26*d*, the heat medium flow control device 24*c* and/or the heat medium flow control device 24*d* only need to be opened so as to allow the heat medium to circulate.

[Heating Main Operation Mode]

Figure 21:
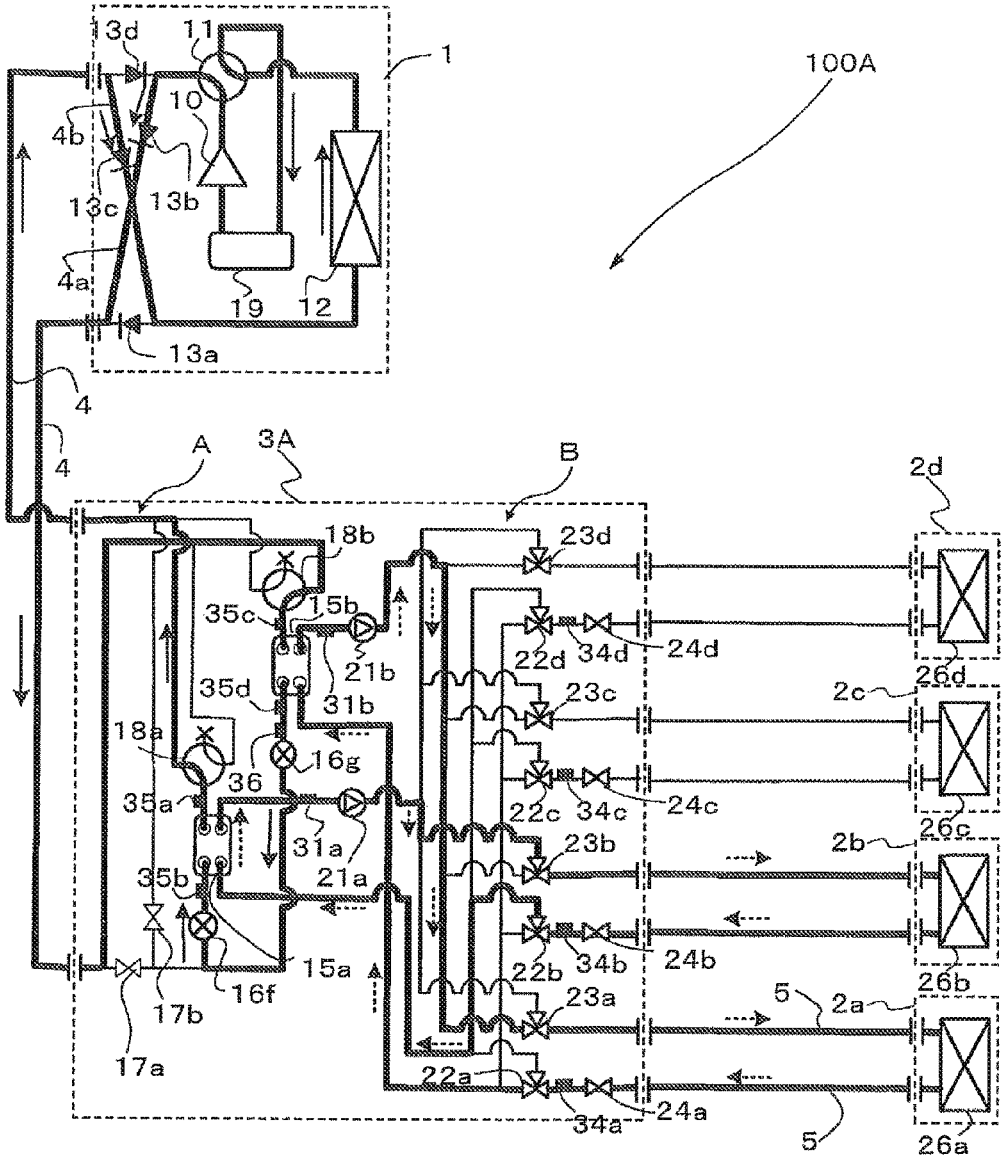
FIG. 21 is a refrigerant circuit diagram illustrating the flow of a refrigerant when an air-conditioning apparatus according to Embodiment of the invention is in a heating main operation mode.

FIG. 21 is a refrigerant circuit diagram illustrating the flow of the refrigerant when the air-conditioning apparatus 100A is in the heating main operation mode. Referring to FIG. 21, the heating main operation mode will be described with an exemplary case in which there is a heating load in the use side heat exchanger 26*a* and a cooling load in the use side heat exchanger 26*b*. In FIG. 21, pipes represented by the bold lines are pipes through which the refrigerants (the heat source side refrigerant and the heat medium) flow. Furthermore, in FIG. 21, the direction of flow of the heat source side refrigerant is indicated by the solid-line arrows, and the direction of flow of the heat medium is indicated by the broken-line arrows.

In the heating main operation mode illustrated in FIG. 21, the four-way valve 11 in the outdoor unit 1 switches such that the heat source side refrigerant that has been discharged from the compressor 10 flows into the heat medium relay unit 3A without flowing through the heat source side heat exchanger 12. In the heat medium relay unit 3A, the first heat medium delivering device 21*a* and the second heat medium delivering device 21*b* are driven, the heat medium flow control device 24*a* and the heat medium flow control device 24*b* are open, and the heat medium flow control device 24*c* and the heat medium flow control device 24*d* are closed. Thus, the heat medium is allowed to circulate between the first heat exchanger related to heat medium 15*a* and the use side heat exchanger 26*a* and between the second heat exchanger related to heat medium 15*b* and the use side heat exchanger 26*b*.

First, the flow of the heat source side refrigerant in the refrigerant circulation circuit A will be described.

Low temperature and low pressure refrigerant is compressed by the compressor 10 and is discharged as high temperature and high pressure gas refrigerant. The high temperature and high pressure gas refrigerant that has been discharged from the compressor 10 flows through the four-way valve 11, is directed through the first connection pipe 4*a*, and flows through the check valve 13*b* and out of the outdoor unit 1. The high temperature and high pressure gas refrigerant that has flowed out of the outdoor unit 1 flows through the refrigerant pipe 4 into the heat medium relay unit 3A. The high temperature and high pressure gas refrigerant that has flowed into the heat medium relay unit 3A flows through the refrigerant flow switching device 18*b* into the second heat exchanger related to heat medium 15*b* functioning as a condenser.

The gas refrigerant that has flowed into the second heat exchanger related to heat medium 15*b* is condensed and liquefied while transferring its heat to the heat medium circulating through the heat medium circulation circuit B, thereby turning into a liquid refrigerant. The liquid refrigerant that has flowed out of the second heat exchanger related to heat medium 15*b* is expanded by the expansion device 16*g*, thereby turning into a low pressure, two-phase refrigerant. The low pressure, two-phase refrigerant flows through the expansion device 16*f* into the first heat exchanger related to heat medium 15*a* functioning as an evaporator. The low pressure, two-phase refrigerant that has flowed into the first heat exchanger related to heat medium 15*a* evaporates by receiving heat from the heat medium circulating through the heat medium circulation circuit B, thereby cooling the heat medium. The low pressure, two-phase refrigerant flows out of the first heat exchanger related to heat medium 15*a*, flows through the second refrigerant flow switching device 18*a* and out of the heat medium relay unit 3A, and flows through the refrigerant pipe 4 into the outdoor unit 1 again.

The refrigerant that has flowed into the outdoor unit 1 flows through the check valve 13*c* into the heat source side heat exchanger 12 functioning as an evaporator. In the heat source side heat exchanger 12, the refrigerant that has flowed into the heat source side heat exchanger 12 receives heat from the outdoor air, thereby turning into a low temperature and low pressure gas refrigerant. The low temperature and low pressure gas refrigerant that has flowed out of the heat source side heat exchanger 12 flows through the four-way valve 11 and the accumulator 19, and is sucked into the compressor 10 again.

In this case, the opening degree of the expansion device 16*g* is controlled such that the subcool obtained as the difference between the saturation temperature that is a conversion of the pressure detected by the pressure sensor 36 and the temperature detected by the first refrigerant temperature sensor 35*b* is constant. Furthermore, the expansion device 16*f* is fully open, the opening/closing device 17*a* is closed, and the opening/closing device 17*b* is closed. The subcool may alternatively be controlled by the expansion device 16*f* with the expansion device 16*g* fully open.

Now, the flow of the heat medium in the heat medium circulation circuit B will be described.

In the heating main operation mode, heating energy of the heat source side refrigerant is transferred to the heat medium in the second heat exchanger related to heat medium 15*b*, and the heat medium thus heated is made to flow through corresponding ones of the pipes 5 by the second heat medium delivering device 21*b*. Furthermore, in the heating main operation mode, cooling energy of the heat source side refrigerant is transferred to the heat medium in the first heat exchanger related to heat medium 15*a*, and the heat medium thus cooled is made to flow through corresponding ones of the pipes 5 by the first heat medium delivering device 21*a*. The heat medium that has been pressurized by and has flowed out of the first heat medium delivering device 21*a* and the second heat medium delivering device 21*b* flows through the second heat medium flow switching device 23*b* and the second heat medium flow switching device 23*a* into the use side heat exchanger 26*b* and the use side heat exchanger 26*a*, respectively.

In the use side heat exchanger 26*b*, the heat medium receives heat from the indoor air, whereby the indoor space 7 is cooled. In the use side heat exchanger 26*a*, the heat medium transfers its heat to the indoor air, whereby the indoor space 7 is heated. In this case, the heat medium flow control device 24*a* and the heat medium flow control device 24*b* function such that the flow rates of the heat medium flowing into the use side heat exchanger 26*a* and the use side heat exchanger 26*b* be values required to cover the air conditioning loads demanded in the rooms, respectively. The cold heat medium that has flowed out of the heat medium flow control device 24*b* flows through the first heat medium flow switching device 22*b* into the first heat exchanger related to heat medium 15*a* and is sucked into the first heat medium delivering device 21*a* again. The hot heat medium that has flowed out of the heat medium flow control device 24*a* flows through the first heat medium flow switching device 22*a* into the second heat exchanger related to heat medium 15*b* and is sucked into the second heat medium delivering device 21*b* again.

During the above sequence, the first heat medium flow switching devices 22 and the second heat medium flow switching devices 23 operate so as to prevent the hot heat medium and the cold heat medium from being mixed together. Therefore, the hot heat medium and the cold heat medium are directed to the respective use side heat exchangers 26 with heating load and cooling load. In the pipes 5 of the use side heat exchangers 26, on both the heating side and the cooling side, the heat medium flows in a direction from the second heat medium flow switching devices 23 toward the first heat medium flow switching devices 22 through the heat medium flow control devices 24. The air conditioning loads demanded in the indoor spaces 7 can be covered by controlling, on the heating side, the difference between the temperature detected by the first temperature sensor 31*b* and the temperature detected by the second temperature sensor 32 and, on the cooling side, the difference between the temperature detected by the second temperature sensor 32 and the temperature detected by the first temperature sensor 31*a* to be maintained at respective target values.

In the heating main operation mode, there is no need to make the heat medium flow into use side heat exchangers 26 in which there is no heating load (including those in the thermo-off state). Therefore, relevant flow paths are closed by the relevant heat medium flow control devices 24, so that the heat medium does not flow into such use side heat exchangers 26. In FIG. 21, the heat medium is made to flow into the use side heat exchanger 26*a* and the use side heat exchanger 26*b* with heating loads. On the other hand, there is no heating load in the use side heat exchanger 26*c* and the use side heat exchanger 26*d*, and the corresponding heat medium flow control device 24*c* and heat medium flow control device 24*d* are therefore fully closed. If there is any heating load on the use side heat exchanger 26*c* and/or the use side heat exchanger 26*d*, the heat medium flow control device 24*c* and/or the heat medium flow control device 24*d* only need to be opened so as to allow the heat medium to circulate.

In the air-conditioning apparatus 100 (and in the air-conditioning apparatus 100A also), when there are only heating loads or cooling loads in any use side heat exchangers 26, the opening degrees of the corresponding first heat medium flow switching devices 22 and second heat medium flow switching devices 23 are set to intermediate values, so that the heat medium is allowed to flow through both the first heat exchanger related to heat medium 15*a* and the second heat exchanger related to heat medium 15*b*. Thus, both the first heat exchanger related to heat medium 15*a* and the second heat exchanger related to heat medium 15*b* are used for the heating operation or the cooling operation. Therefore, the heat transfer area is increased, and an efficient heating or cooling operation can be performed.

When heating loads and cooling loads are simultaneously performed in the use side heat exchangers 26, the first heat medium flow switching devices 22 and the second heat medium flow switching devices 23 corresponding to the use side heat exchangers 26 that are in the heating operation switch such that the flow paths are connected to the first heat exchanger related to heat medium 15*b* intended for heating, and the first heat medium flow switching devices 22 and the second heat medium flow switching devices 23 corresponding to the use side heat exchangers 26 that are in the cooling operation switch such that the flow paths are connected to the first heat exchanger related to heat medium 15*a* intended for cooling. Thus, each of the indoor units 2 can arbitrarily perform the heating operation or the cooling operation.

Figure 22:
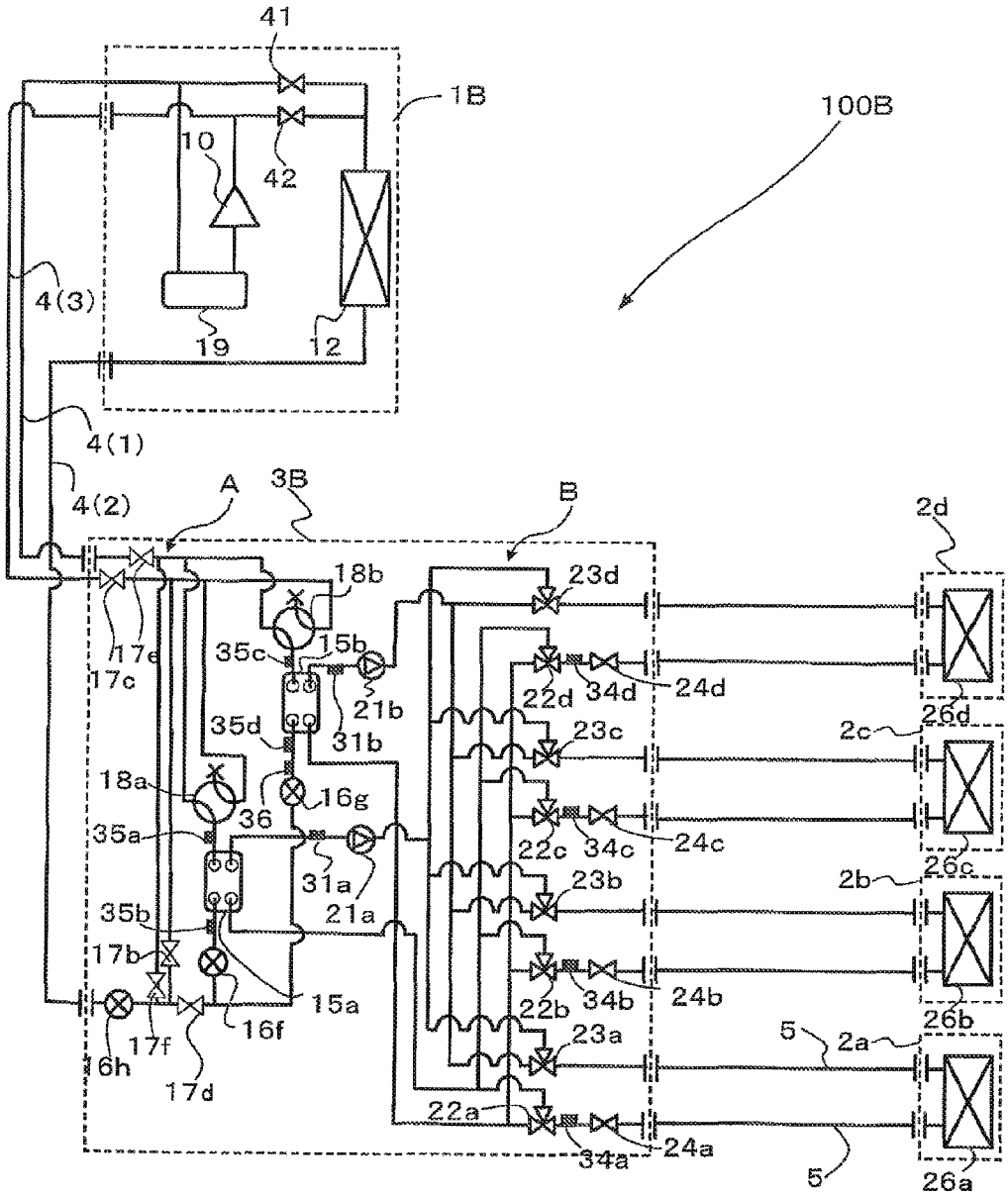
FIG. 22 is a schematic circuit configuration diagram illustrating an exemplary circuit configuration of an air-conditioning apparatus according to Embodiment of the invention.

As illustrated in FIG. 22, the air-conditioning apparatus according to Embodiment may alternatively be an apparatus (hereinafter denoted as air-conditioning apparatus 100B) in which an outdoor unit (hereinafter denoted as outdoor unit 1B) and a heat medium relay unit (hereinafter denoted as heat medium relay unit 3B) are connected to each other with three refrigerant pipes 4 (a refrigerant pipe 4(1), a refrigerant pipe 4(2), and a refrigerant pipe 4(3)). The air-conditioning apparatus 100B allows all indoor units 2 to perform the same operation and also allows the indoor units 2 to perform individually different operations. The refrigerant pipe 4(2) in the heat medium relay unit 3B is provided with an expansion device 16*h* (for example, an electronic expansion valve) for merging high-pressure liquid in the cooling main operation mode.

Although the basic configuration of the air-conditioning apparatus 100B is the same as that of the air-conditioning apparatus 100 or the air-conditioning apparatus 100A, the configurations of the outdoor unit 1B and the heat medium relay unit 3B are slightly different. The outdoor unit 1B is equipped with a compressor 10, a heat source side heat exchanger 12, an accumulator 19, and two flow switchers (a flow switcher 41 and a flow switcher 42). The heat medium relay unit 3B is not provided with any opening/closing device 17*a* and any refrigerant pipe branching from the refrigerant pipe 4(2) and connecting to the refrigerant flow switching device 18*b*. Instead, the heat medium relay unit 3B includes an opening/closing device 17*c* and an opening/closing device 17*d*. Furthermore, the branch pipe having the opening/closing device 17*b* is connected to the refrigerant pipe 4(3). The heat medium relay unit 3B also provided with a branch pipe connecting the refrigerant pipe 4(1) and the refrigerant pipe 4(2) to each other, an opening/closing device 17*e*, and an opening/closing device 17*f*.

The refrigerant pipe 4(3) connects the discharge pipe of the compressor 10 and the heat medium relay unit 3B to each other. The two flow switchers are two-way valves or the like and open and close the respective refrigerant pipes 4. The flow switcher 41 is provided between the suction pipe of the compressor 10 and the heat source side heat exchanger 12 and is controlled to open and close, thereby switching the flow of the heat source side refrigerant. The flow switcher 42 is provided between the discharge pipe of the compressor 10 and the heat source side heat exchanger 12 and is controlled to open and close, thereby switching the flow of the heat source side refrigerant.

The opening/closing devices 17*c* to 17*f* are two-way valves or the like and open and close the respective refrigerant pipes 4. The opening/closing device 17*c* is provided in the heat medium relay unit 3B and in the refrigerant pipe 4(3), and opens and closes the refrigerant pipe 4(3). The opening/closing device 17*d* is provided in the heat medium relay unit 3B and in the refrigerant pipe 4(2), and opens and closes the refrigerant pipe 4(2). The opening/closing device 17*e* is provided in the heat medium relay unit 3B and in the refrigerant pipe 4(1), and opens and closes the refrigerant pipe 4(1). The opening/closing device 17*f* is provided in the heat medium relay unit 3B and in the branch pipe connecting the refrigerant pipe 4(1) and the refrigerant pipe 4(2) to each other, and opens and closes the branch pipe. The opening/closing device 17*e* and the opening/closing device 17*f* allow the refrigerant to flow into the heat source side heat exchanger 12 of the outdoor unit 1.

Referring to FIG. 22, operation modes that the air-conditioning apparatus 100B undergoes will now be described briefly. The flow of the heat medium in the heat medium circulation circuit B is the same as that of the air-conditioning apparatus 100, and description thereof is omitted.

[Cooling Only Operation Mode]

In the cooling only operation mode, it is controlled that the flow switcher 41 is closed, the flow switcher 42 is open, the opening/closing device 17*b* is closed, the opening/closing device 17*c* is closed, the opening/closing device 17*d* is open, the opening/closing device 17*e* is open, and the opening/closing device 17*f* is closed.

Low temperature and low pressure refrigerant is compressed by the compressor 10 and is discharged as high temperature and high pressure gas refrigerant. The entirety of the high temperature and high pressure gas refrigerant that has been discharged from the compressor 10 flows through the flow switcher 42 into the heat source side heat exchanger 12 and is condensed and liquefied in the heat source side heat exchanger 12 by transferring its heat to the outdoor air, thereby turning into high pressure liquid refrigerant. The high pressure liquid refrigerant that has flowed out of the heat source side heat exchanger 12 flows through the refrigerant pipe 4(2) into the heat medium relay unit 3B. The high pressure liquid refrigerant that has flowed into the heat medium relay unit 3B is branched, where the liquid refrigerant is expanded by the expansion device 16*f* and the expansion device 16*g*, thereby turning into a low temperature and low pressure, two-phase refrigerant.

The two-phase refrigerant flows into both the first heat exchanger related to heat medium 15*a* and the second heat exchanger related to heat medium 15*b* functioning as evaporators and cools the heat medium by receiving heat from the heat medium circulating through the heat medium circulation circuit B, thereby turning into a low temperature and low pressure gas refrigerant. The gas refrigerant that has flowed out of the first heat exchanger related to heat medium 15*a* and the second heat exchanger related to heat medium 15*b* flows through the refrigerant flow switching device 18*a* and the refrigerant flow switching device 18*b*, is then merged, flows through the opening/closing device 17*e* and out of the heat medium relay unit 3B, and flows through the refrigerant pipe 4(1) into the outdoor unit 1B again. The refrigerant that has flowed into the outdoor unit 1B flows through the accumulator 19 and is sucked into the compressor 10 again.

[Heating Only Operation Mode]

In the heating only operation mode, it is controlled that the flow switcher 41 is open, the flow switcher 42 is closed, the opening/closing device 17*b* is closed, the opening/closing device 17*c* is open, the opening/closing device 17*d* is open, the opening/closing device 17*e* is closed, and the opening/closing device 17*f* is closed.

Low temperature and low pressure refrigerant is compressed by the compressor 10 and is discharged as high temperature and high pressure gas refrigerant. The entirety of the high temperature and high pressure gas refrigerant that has been discharged from the compressor 10 flows through the refrigerant pipe 4(3) and out of the outdoor unit 1B. The high temperature and high pressure gas refrigerant that has flowed out of the outdoor unit 1B flows through the refrigerant pipe 4(3) into the heat medium relay unit 3B. The high temperature and high pressure gas refrigerant that has flowed into the heat medium relay unit 3B is branched and flows through the refrigerant flow switching device 18*a* and the refrigerant flow switching device 18*b* into both the first heat exchanger related to heat medium 15*a* and the second heat exchanger related to heat medium 15*b*.

The high temperature and high pressure gas refrigerant that has flowed into the first heat exchanger related to heat medium 15*a* and the second heat exchanger related to heat medium 15*b* is condensed and liquefied while transferring its heat to the heat medium circulating through the heat medium circulation circuit B, thereby turning into high pressure liquid refrigerant. The liquid refrigerant that has flowed out of the first heat exchanger related to heat medium 15*a* and the second heat exchanger related to heat medium 15*b* is expanded by the expansion device 16*f* and the expansion device 16*g*, thereby turning into a low temperature and low pressure, two-phase refrigerant. The two-phase refrigerant flows through the opening/closing device 17*d* and out of the heat medium relay unit 3B and flows through the refrigerant pipe 4(2) into the outdoor unit 1B again.

The refrigerant that has flowed into the outdoor unit 1B flows into the heat source side heat exchanger 12 functioning as an evaporator. The refrigerant that has flowed into the heat source side heat exchanger 12 receives heat from the outdoor air in the heat source side heat exchanger 12, thereby turning into a low temperature and low pressure gas refrigerant. The low temperature and low pressure gas refrigerant that has flowed out of the heat source side heat exchanger 12 flows through the flow switcher 41 and the accumulator 19, and is sucked into the compressor 10 again.

[Cooling Main Operation Mode]

Now, the cooling main operation mode will be described with an exemplary case in which there is a cooling load in the use side heat exchanger 26*a* and a heating load in the use side heat exchanger 26*b*. In the cooling main operation mode, it is controlled that the flow switcher 41 is closed, the flow switcher 42 is open, the opening/closing device 17*b* is open, the opening/closing device 17*c* is closed, the opening/closing device 17*d* is closed, the opening/closing device 17*e* is open, and the opening/closing device 17*f* is closed.

Low temperature and low pressure refrigerant is compressed by the compressor 10 and is discharged as high temperature and high pressure gas refrigerant. The entirety of the high temperature and high pressure gas refrigerant that has been discharged from the compressor 10 flows through the flow switcher 42 into the heat source side heat exchanger 12 and is condensed in the heat source side heat exchanger 12 by transferring its heat to the outdoor air, thereby turning into a two-phase refrigerant. The two-phase refrigerant that has flowed out of the heat source side heat exchanger 12 flows through the refrigerant pipe 4(2) into the heat medium relay unit 3B. The two-phase refrigerant that has flowed into the heat medium relay unit 3B flows through the opening/closing device 17*b* and the refrigerant flow switching device 18*b* into the second heat exchanger related to heat medium 15*b* functioning as a condenser.

The two-phase refrigerant that has flowed into the second heat exchanger related to heat medium 15*b* is condensed and liquefied while transferring its heat to the heat medium circulating through the heat medium circulation circuit B, thereby turning into a liquid refrigerant. The liquid refrigerant that has flowed out of the second heat exchanger related to heat medium 15*b* is expanded by the expansion device 16*g*, thereby turning into a low pressure, two-phase refrigerant. The low pressure, two-phase refrigerant flows through the expansion device 16*f* into the first heat exchanger related to heat medium 15*a* functioning as an evaporator. The low pressure, two-phase refrigerant that has flowed into the first heat exchanger related to heat medium 15*a* cools the heat medium by receiving heat from the heat medium circulating through the heat medium circulation circuit B, thereby turning into a gas refrigerant at a low pressure. The gas refrigerant flows out of the first heat exchanger related to heat medium 15*a*, flows through the second refrigerant flow switching device 18*a* and the opening/closing device 17*e* and out of the heat medium relay unit 3B, and flows through the refrigerant pipe 4(1) into the outdoor unit 1B again. The refrigerant that has flowed into the outdoor unit 1B flows through the accumulator 19 and is sucked into the compressor 10 again.

[Heating Main Operation Mode]

Now, the heating main operation mode will be described with an exemplary case in which there is a heating load in the use side heat exchanger 26*a* and a cooling load in the use side heat exchanger 26*b*. In the heating main operation mode, it is controlled that the flow switcher 41 is open, the flow switcher 42 is closed, the opening/closing device 17*b* is closed, the opening/closing device 17*c* is open, the opening/closing device 17*d* is closed, the opening/closing device 17*e* is closed, and the opening/closing device 17*f* is open.

Low temperature and low pressure refrigerant is compressed by the compressor 10 and is discharged as high temperature and high pressure gas refrigerant. The entirety of the high temperature and high pressure gas refrigerant that has been discharged from the compressor 10 flows through the refrigerant pipe 4(3) and out of the outdoor unit 1B. The high temperature and high pressure gas refrigerant that has flowed out of the outdoor unit 1B flows through the refrigerant pipe 4(3) into the heat medium relay unit 3B. The high temperature and high pressure gas refrigerant that has flowed into the heat medium relay unit 3B flows through the opening/closing device 17*c* and the refrigerant flow switching device 18*b* into the second heat exchanger related to heat medium 15*b* functioning as a condenser.

The gas refrigerant that has flowed into the second heat exchanger related to heat medium 15*b* is condensed and liquefied while transferring its heat to the heat medium circulating through the heat medium circulation circuit B, thereby turning into a liquid refrigerant. The liquid refrigerant that has flowed out of the second heat exchanger related to heat medium 15*b* is expanded by the expansion device 16*g*, thereby turning into a low pressure, two-phase refrigerant. The low pressure, two-phase refrigerant flows through the expansion device 16*f* into the first heat exchanger related to heat medium 15*a* functioning as an evaporator. The low pressure, two-phase refrigerant that has flowed into the first heat exchanger related to heat medium 15*a* evaporates by receiving heat from the heat medium circulating through the heat medium circulation circuit B, thereby cooling the heat medium. The low pressure, two-phase refrigerant flows out of the first heat exchanger related to heat medium 15*a*, flows through the second refrigerant flow switching device 18*a* and the opening/closing device 17*f* and out of the heat medium relay unit 3B, and flows through the refrigerant pipe 4(2) into the outdoor unit 1B again.

The refrigerant that has flowed into the outdoor unit 1B flows into the heat source side heat exchanger 12 functioning as an evaporator. The refrigerant that has flowed into the heat source side heat exchanger 12 receives heat from the outdoor air in the heat source side heat exchanger 12, thereby turning into a low temperature and low pressure gas refrigerant. The low temperature and low pressure gas refrigerant that has flowed out of the heat source side heat exchanger 12 flows through the flow switcher 41 and the accumulator 19 and is sucked into the compressor 10 again.

The first heat medium flow switching devices 22 and the second heat medium flow switching devices 23 described in Embodiment each only need to be capable of switching the flow path: for example, a device, such as a three-way valve, capable of switching among three flow paths; or a combination of two devices, such as on-off valves, each opening and closing two flow paths. Alternatively, the first heat medium flow switching devices 22 and the second heat medium flow switching devices 23 may each be a device, such as a stepping-motor-driven mixing valve, capable of changing the flow rates of three flow paths; or a combination of two devices, such as electronic expansion valves, each capable of changing the flow rates of two flow paths. In such a case, the occurrence of water hammer due to a sudden opening or closing of the flow path can be prevented. Furthermore, although Embodiment has been described with an exemplary case in which the heat medium flow control devices 24 are stepping-motor-driven two-way valves, each of the heat medium flow control device 24 may alternatively be a control valve having three flow paths and may be provided together with a bypass pipe that bypasses the use side heat exchanger 26.

Exemplary heat source side refrigerants include single component refrigerants such as R-22 and R-134a, near-azeotropic refrigerant mixtures such as R-410A and R-404A, non-zeotropic refrigerant mixtures such as R-407C, refrigerants such as $CF_3CF{=}CH_2$ each containing a double bond in its chemical formula and having a relatively small global warming potential and mixtures containing such refrigerants, and natural refrigerants such as $CO_2$ and propane. In the heat exchanger related to heat medium 15*a* or the heat exchanger related to heat medium 15*b* operating for a heating purpose, a refrigerant that undergoes normal two-phase change is condensed and liquefied, whereas a refrigerant such as $CO_2$ that goes into a supercritical state is cooled in the supercritical state. In either case, both refrigerants behave in the same manner in the other respects and produce the same effect.

Exemplary heat transfer media include brine (antifreeze), water, a mixture of brine and water, a mixture of water and an additive with highly anti-corrosive effect, and the like. Therefore, in the air-conditioning apparatus 100 (hereinafter, in the air-conditioning apparatus 100A and the air-conditioning apparatus 100B also), even if the heat medium leaks out into indoor spaces 7 through indoor units 2, the heat medium employed is highly safe and therefore contributes to the improvement of safety.

Although Embodiment has been described with an exemplary case in which the air-conditioning apparatus 100 includes the accumulator 19, the accumulator 19 may be omitted. Although Embodiment has been described with an exemplary case in which the air-conditioning apparatus 100 includes the check valves 13*a* to 13*d*, these parts are not essential. Hence, needless to say, even if the accumulator 19 and the check valves 13*a* to 13*d* are not provided, the air-conditioning apparatus 100 operates in the same manner and produces the same effects.

In general, the heat source side heat exchanger 12 and the use side heat exchangers 26 are often provided with blowers, and condensation or evaporation is promoted with blow of air. However, the invention is not limited to such a case. For example, the use side heat exchangers 26 may each be a panel heater or the like utilizing radiation, and the heat source side heat exchanger 12 may be of a water-cooled type in which heat is transferred by utilizing water or antifreeze. That is, the heat source side heat exchanger 12 and the use side heat exchangers 26 may be of any type, as long as they are capable of transferring or receiving heat. Moreover, the number of use side heat exchangers 26 is not specifically limited.

Although Embodiment has been described with an exemplary case in which one first heat medium flow switching device 22, one second heat medium flow switching device 23, and one heat medium flow control device 24 are connected to each of the use side heat exchangers 26, the invention is not limited thereto. One use side heat exchanger 26 may be connected to a plurality of each of the foregoing devices. In such a case, the first heat medium flow switching devices, the second heat medium flow switching devices, and the heat medium flow control devices connected to one use side heat exchanger 26 only need to be operated in the same manners.

Although Embodiment has been described with an exemplary case in which two heat exchangers related to heat medium 15 are provided, the invention is not limited thereto, naturally. As long as the heat medium can be cooled and/or heated, any number of heat exchangers related to heat medium 15 may be provided. Furthermore, the number of first heat medium delivering devices 21*a* and the number of second heat medium delivering devices 21*b* are each not limited to one, and a plurality of pumps having small capacities may alternatively be provided in parallel.

REFERENCE SIGNS LIST

1: outdoor unit, 1B: outdoor unit, 2: indoor unit, 2*a*: indoor unit, 2*b*: indoor unit, 2*c*: indoor unit, 2*d*: indoor unit, 3: heat medium relay unit, 3A: heat medium relay unit, 3B: heat medium relay unit, 3*a*: heat medium main-relay unit, 3*b*: heat medium sub-relay unit, 4: refrigerant pipe, 4*a*: first connection pipe, 4*b*: second connection pipe, 5: pipe, 5*a*: pipe, 5*b*: pipe, 6: outdoor space, 7: indoor space, 8: space, 9: building, 10: compressor, 11: four-way valve, 12: heat source side heat exchanger, 13*a*: check valve, 13*b*: check valve, 13*c*: check valve, 13*d*: check valve, 14: gas-liquid separator, 15: heat exchanger related to heat medium, 15*a*: first heat exchanger related to heat medium, 15*b*: second heat exchanger related to heat medium, 16: expansion device, 16*a*: expansion device, 16*b*: expansion device, 16*c*: expansion device, 16*d*: expansion device, 16*e*: expansion device, 16*f*: expansion device, 16*g*: expansion device, 16*h*: expansion device, 17: opening/closing device, 17*a*: opening/closing device, 17*b*: opening/closing device, 17*c*: opening/closing device, 17*d*: opening/closing device, 17*e*: opening/closing device, 17*f*: opening/closing device, 18: refrigerant flow switching device, 18*a*: refrigerant flow switching device, 18*b*: refrigerant flow switching device, 19: accumulator, 21: heat medium delivering device, 21*a*: first heat medium delivering device, 21*b*: second heat medium delivering device, 22: first heat medium flow switching device, 22*a*: first heat medium flow switching device, 22*b*: first heat medium flow switching device, 22*c*: first heat medium flow switching device, 22*d*: first heat medium flow switching device, 23: second heat medium flow switching device, 23*a*: second heat medium flow switching device, 23*b*: second heat medium flow switching device, 23*c*: second heat medium flow switching device, 23*d*: second heat medium flow switching device, 24: heat medium flow control device, 24*a*: heat medium flow control device, 24*b*: heat medium flow control device, 24*c*: heat medium flow control device, 24*d*: heat medium flow control device, 26: use side heat exchanger, 26*a*: use side heat exchanger, 26*b*: use side heat exchanger, 26*c*: use side heat exchanger, 26*d*: use side heat exchanger, 31: first temperature sensor, 31*a*: first temperature sensor, 31*b*: first temperature sensor, 32: second temperature sensor, 32*a*: second temperature sensor, 32*b*: second temperature sensor, 33: third temperature sensor, 33*a*: third temperature sensor, 33*b*: third temperature sensor, 33*c*: third temperature sensor, 33*d*: third temperature sensor, 34: fourth temperature sensor, 34*a*: fourth temperature sensor, 34*b*: fourth temperature sensor, 34*c*: fourth temperature sensor, 34*d*: fourth temperature sensor, 35: first refrigerant temperature sensor, 35*a*: first refrigerant temperature sensor, 35*b*: first refrigerant temperature sensor, 35*c*: first refrigerant temperature sensor, 35*d*: first refrigerant temperature sensor, 36: pressure sensor, 37: second refrigerant temperature sensor, 38: refrigerant temperature detecting means, 41: flow switcher, 42: flow switcher, 100: air-conditioning apparatus, 100A: air-conditioning apparatus, 100B: air-conditioning apparatus, 300: valve block unit, 301: first branch pipe, 302: second branch pipe, 305: cooling main return pipe, 306: heating main return pipe, 307: cooling main supply pipe, 308: heating main supply pipe, 320: connecting means, 350: valve block, 350*a*: valve block, 350*b*: valve block, 350*c*: valve block, 350*d*: valve block, 600: housing, 600*a*: first housing,

600*b*: second housing, 700: metal fixing plate, 701*a*: metal fixing plate, 701*b*: metal fixing plate, 702: adapter, 702*a*: adapter, 702*b*: adapter, 703: metal member, 704*a*: strainer, 704*b*: strainer, 706: adapter, 707*a*: O-ring, 707*b*: O-ring, 708: suction pipe, 709: discharge pipe, 710: space, 800: housing, 800*a*: lid body, 800*b*: upper housing, 800*c*: lower housing, A: refrigerant circulation circuit, B: heat medium circulation circuit.

The invention claimed is:

1. A heat medium relay unit constituting a portion of an air-conditioning apparatus that forms a refrigerant circulation circuit connecting a compressor, a heat source side heat exchanger, a plurality of expansion devices, and refrigerant flow path parts of a plurality of heat exchangers related to heat medium, the refrigerant circulation circuit circulating a heat source side refrigerant, and forms a heat medium circulation circuit connecting a plurality of heat medium delivering devices, a plurality of heat medium flow switching devices, a plurality of heat medium flow control devices, a plurality of use side heat exchangers, and heat medium flow path parts of the plurality of heat exchangers related to heat medium, the heat medium circulation circuit circulating a heat medium, the heat medium relay unit that exchanges heat between the heat source side refrigerant and the heat medium, comprising:

a housing including the expansion devices, the heat exchangers related to heat medium, the heat medium delivering devices, the heat medium flow control devices, and the heat medium flow switching devices together, wherein some devices, which are to be repaired or maintained, and constituting the heat medium circulation circuit, are arranged for a servicing side in a same direction in the housing and the some devices are provided so as to be detachable from the servicing side.

2. The heat medium relay unit of claim 1, wherein the heat medium delivering devices, the heat medium flow switching devices, and the heat medium flow control devices are provided so as to be detachable in a substantially horizontal direction.

3. The heat medium relay unit of claim 1, wherein each of the heat medium delivering devices further comprises a substantially L-shaped adapter on a discharge side of a heat medium, and a direction in which the heat medium is sucked into the heat medium delivering device and a direction in which the heat medium is discharged from the heat medium delivering device are the same.

4. An air-conditioning apparatus comprising the heat medium relay unit of claim 1, comprising an outdoor unit housing the compressor and the heat source side heat exchanger, and an indoor unit housing the corresponding heat exchanger of the use side heat exchangers.

5. The heat medium relay unit of claim 1, wherein the some devices to be repaired or maintained includes the plurality of heat medium delivering devices, the plurality of heat medium flow switching devices and the plurality of heat medium flow control devices.

6. The heat medium relay unit of claim 1, wherein the servicing side is a front side of heat medium relay unit when the heat medium relay unit is installed in a predefined position.

* * * * *